US008177987B2

(12) United States Patent
Nozu et al.

(10) Patent No.: US 8,177,987 B2
(45) Date of Patent: May 15, 2012

(54) METHOD FOR PRODUCING ELECTRON-EMITTING DEVICE AND METHOD FOR PRODUCING IMAGE DISPLAY APPARATUS INCLUDING THE SAME

(75) Inventors: Kyota Nozu, Atsugi (JP); Kenichi Iwata, Fujisawa (JP); Tamaki Kobayashi, Isehara (JP); Shin Kitamura, Machida (JP); Akira Shimazu, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 377 days.

(21) Appl. No.: 12/637,978

(22) Filed: Dec. 15, 2009

(65) Prior Publication Data

US 2010/0159783 A1 Jun. 24, 2010

(30) Foreign Application Priority Data

Dec. 19, 2008 (JP) ..... 2008-324466

(51) Int. Cl.
*H01B 13/00* (2006.01)

(52) U.S. Cl. ..... 216/13; 216/37; 313/495; 313/309; 313/336

(58) Field of Classification Search ..... 216/13, 216/37; 313/495, 309, 336
See application file for complete search history.

(56) References Cited

U.S. PATENT DOCUMENTS 7,786,658 B1 * 8/2010 Tanaka et al. ..... 313/309

FOREIGN PATENT DOCUMENTS

| | | | |
|---|---|---|---|
| JP | 08-045415 | A | 2/1996 |
| JP | 9-245624 | A | 9/1997 |
| JP | 2001-167693 | A | 6/2001 |

* cited by examiner

*Primary Examiner* — Nadine G Norton
*Assistant Examiner* — Maki Angadi
(74) *Attorney, Agent, or Firm* — Canon U.S.A., Inc. IP Division

(57) ABSTRACT

A method for producing an electron-emitting device includes forming a first conductive film on a side surface of an insulation layer including the side surface and a top surface connected to the side surface; forming a second conductive film from the top surface to the side surface and on the first conductive film; and etching the second electrically conductive film.

20 Claims, 12 Drawing Sheets

METHOD FOR PRODUCING ELECTRON-EMITTING DEVICE AND METHOD FOR PRODUCING IMAGE DISPLAY APPARATUS INCLUDING THE SAME

BACKGROUND OF THE INVENTION

1. Field of the Invention

The present invention relates to a method for producing an electron-emitting device and a method for producing an image display apparatus including such an electron-emitting device.

2. Description of the Related Art

An electron-emitting device of a field emission type is configured to field-emit electrons from the surface of a cathode by application of a voltage between the cathode and a gate. Japanese Patent Laid-Open No. 2001-167693 discloses an electron-emitting device in which a cathode is provided along the side surface of an insulation layer formed on a substrate and the insulation layer has a recessed portion.

SUMMARY OF THE INVENTION

Such an electron-emitting device disclosed in Japanese Patent Laid-Open No. 2001-167693 suffers from unintended flow of current (leakage current) depending on a method used to produce the device.

Higher electron emission efficiency has been demanded. Herein, electron emission efficiency ($\eta$) is given by the following expression with current (If) flowing between a cathode electrode and a gate electrode and current (Ie) being drawn into a vacuum upon application of a driving voltage to an electron-emitting device: Efficiency $\eta = Ie/(If + Ie)$.

The present invention provides a method for producing an electron-emitting device having high electron emission efficiency and high reliability.

Accordingly, a method for producing an electron-emitting device according to the present invention includes a first step of forming a first conductive film at least on a side surface of an insulation layer including the side surface and a top surface connected to the side surface; a second step of forming a second conductive film from the top surface to the side surface and on the first conductive film; and a third step of etching the second conductive film, wherein, in the second step, the second conductive film is formed such that a portion of the second conductive film on the top surface has a higher film density than a portion of the second conductive film on the side surface to provide the portion of the second conductive film having a high film density and the portion of the second conductive film having a low film density; and in the third step, the portion of the second conductive film having the low film density is etched more than the portion of the second conductive film having the high film density.

According to the present invention, the electron emission efficiency and the reliability of an electron-emitting device can be enhanced.

Further features of the present invention will become apparent from the following description of exemplary embodiments with reference to the attached drawings.

DESCRIPTION OF THE EMBODIMENTS

Hereinafter, embodiments of the present invention will be specifically described with reference to the drawings. The properties of elements such as sizes, materials, shapes, relative configurations, and the like described in the embodiments are not intended to restrict the scope of the present invention unless otherwise specified.

The configuration of an electron-emitting device produced by a method of an embodiment described below will be described with reference to FIGS. 1A to 3. This method for producing an electron-emitting device will be described after the configuration of an electron-emitting device is described.

Figure 1A:
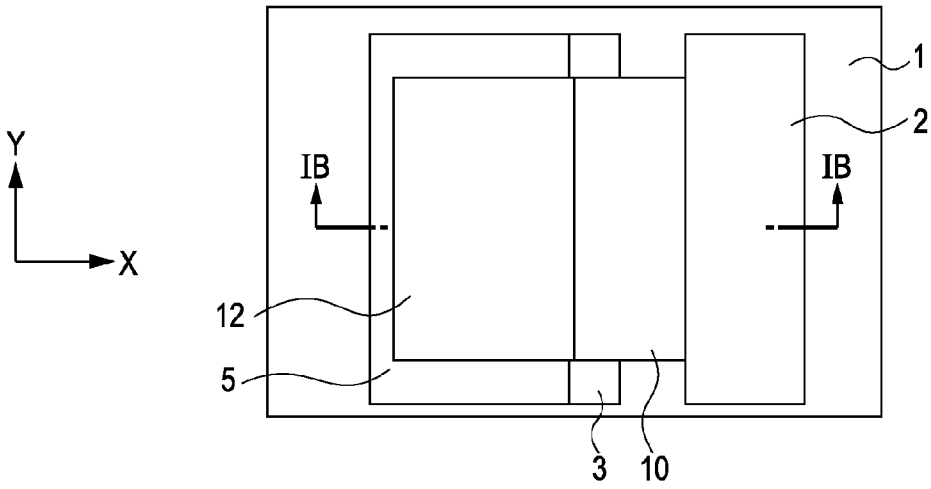
FIGS. 1A to 1C are schematic views of the configuration of an electron-emitting device according to an embodiment of the present invention.
Figure 1B:
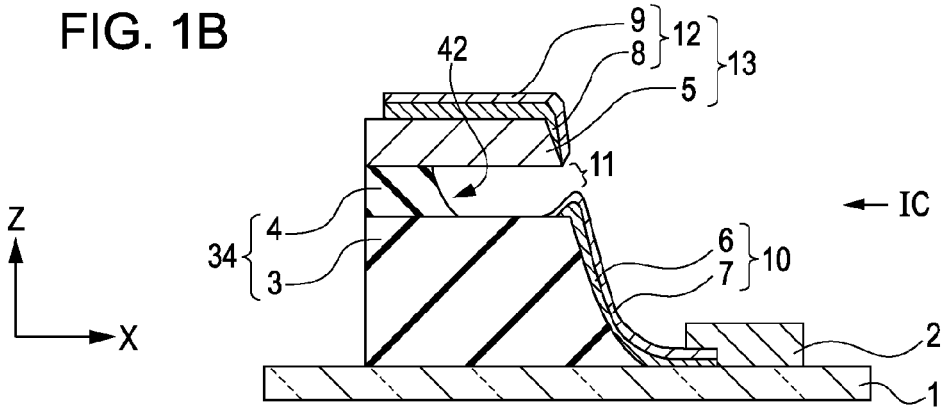
Figure 1C:
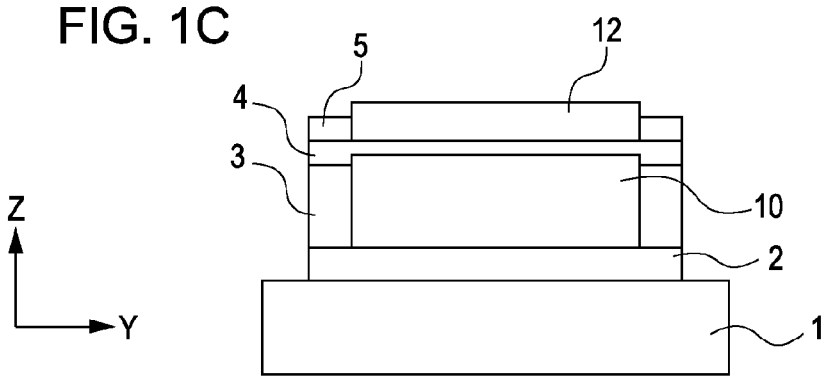
Figure 2:
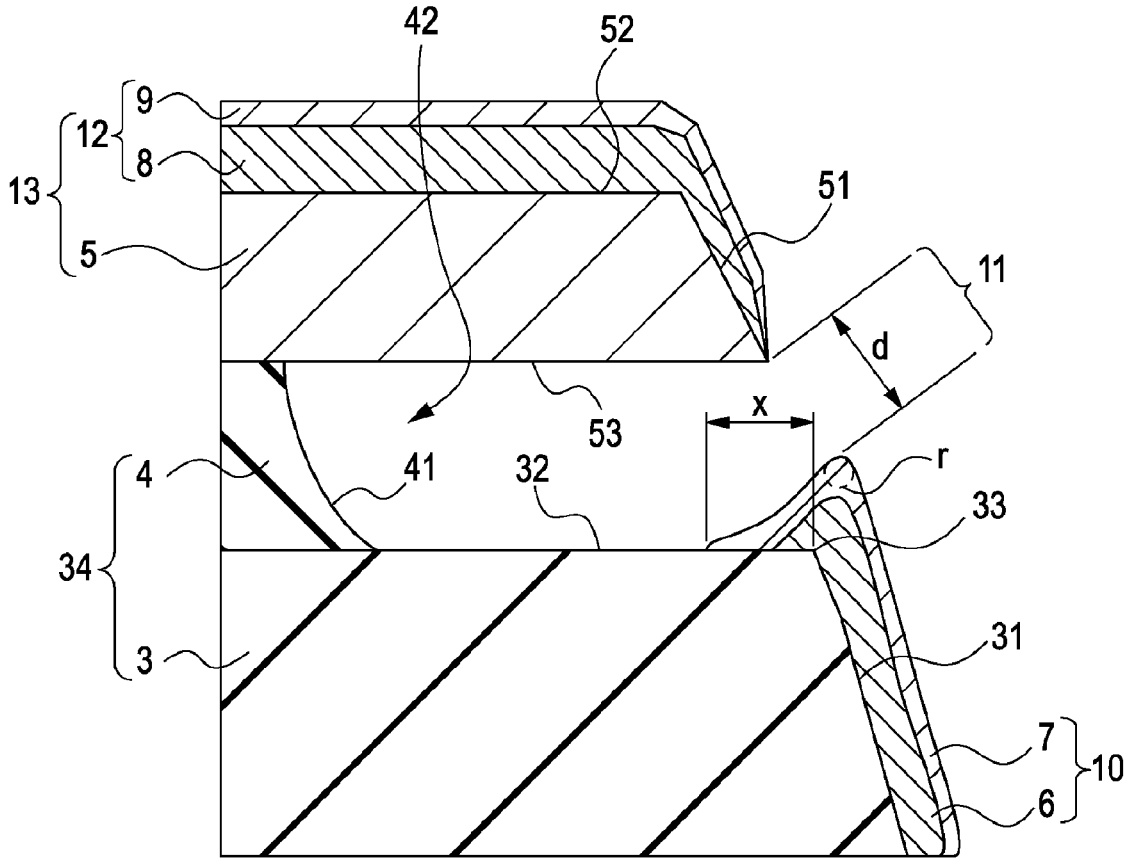
FIG. 2 is an enlarged schematic sectional view illustrating details of an electron-emitting device according to an embodiment of the present invention.

FIG. 1A is a schematic plan view (X-Y plane) of an electron-emitting device. FIG. 1B is a schematic section view (X-Z plane) of the electron-emitting device illustrated in FIG. 1A, the section being taken along section line IB-IB. FIG. 1C is a schematic side view (Z-Y plane) of the electron-emitting device, viewed in the direction represented by arrow IC in FIG. 1B. FIG. 2 is a partial enlarged view of the electron emission portion illustrated in FIG. 1B and an area around the portion.

A cathode electrode 2 and a step-forming member 34 are provided side by side on a substrate 1. The step-forming member 34 is an insulation member constituted by the stack of a first insulation layer 3 and a second insulation layer 4. As specifically illustrated in FIG. 2, a cathode conductive film 10 is provided on a side surface 31, on a side closer to the cathode electrode 2, of the first insulation layer 3 and along the side surface 31. The cathode conductive film 10 in this embodiment includes a first conductive film 6 and a second conductive film 7 that are formed by a production method described below. In the present invention, "conductive" means to have an electrically conductive property.

The side surface 31 of the first insulation layer 3 constituting the step-forming member 34 includes an inclined surface. In a production method according to the present invention, the side surface 31 is desirably an inclined surface (inclined surface 31) having an angle of less than 90° with respect to the surface of the substrate 1. Note that the angle between a side surface 41 of the second insulation layer 4 and the substrate 1 is not particularly restricted as long as electron emission is not hampered.

A gate electrode 5 is provided above (in the +Z direction) the first insulation layer 3 with the second insulation layer 4 therebetween such that the gate electrode 5 is separated from the first insulation layer 3 by a predetermined distance (thickness of the second insulation layer 4). In this embodiment, a gate conductive film 12 is provided on the gate electrode 5. The gate conductive film 12 in this embodiment includes a third conductive film 8 and a fourth conductive film 9 that are formed by a production method described below.

A recessed portion 42 is surrounded by the first insulation layer 3, the second insulation layer 4, and the gate electrode 5. Referring to FIG. 2, specifically, the recessed portion 42 is a space surrounded by a top surface 32 of the first insulation layer 3, the side surface 41 of the second insulation layer 4, and a bottom surface 53 of the gate electrode 5.

The cathode conductive film 10 covers a corner portion 33 along which the side surface 31 of the first insulation layer 3 and the top surface 32 of the first insulation layer 3 are connected to each other. The cathode conductive film 10 is provided not only on the side surface 31 of the first insulation layer 3 but also on the top surface 32 of the first insulation layer 3. Stated another way, a portion of the cathode conductive film 10 is in the cathode electrode 2 and the cathode conductive film 10 extends into the recessed portion 42. That is, the cathode conductive film 10 extends from the cathode electrode 2 along the side surface 31 of the first insulation layer 3 to the top surface 32 of the first insulation layer 3.

As illustrated in FIG. 2, the cathode conductive film 10 enters the recessed portion 42 by distance x from the corner portion 33 along which the side surface 31 of the first insulation layer 3 and the top surface 32 of the first insulation layer 3 are connected to each other. Stated another way, the distance x is a length over which the top surface 32 of the first insulation layer 3 and the cathode conductive film 10 are in contact with each other.

The entry of the cathode conductive film 10 by the distance x into the recessed portion 42 provides the following three merits: (1) the area in which the cathode conductive film 10 serving as an electron emission portion is in contact with the first insulation layer 3 is large, which enhances mechanical adhesion (adhesion strength) between the cathode conductive film 10 and the first insulation layer 3; (2) the area in which the cathode conductive film 10 serving as an electron emission portion is in contact with the first insulation layer 3 is large, which permits heat generated in the electron emission portion to dissipate efficiently (reduction in thermal resistance); and (3) an inclination of the cathode conductive film 10 with respect to the top surface 32 of the first insulation layer 3 leads to reduction in the intensity of an electric field generated at the triple point in the interface between the insulator, vacuum, and the conductor, which permits the suppression of discharge phenomenon caused by generation of an abnormal electric field.

An end portion of the cathode conductive film 10 includes a projected portion positioned on the corner portion 33 of the first insulation layer 3. Stated another way, the projected portion is positioned so as to straddle the inclined surface 31 of the first insulation layer 3 and the top surface 32 of the first insulation layer 3. The tip of the projected portion is away from the surface of the substrate 1 by a distance larger than the distance between the top surface 32 of the first insulation layer 3 and the surface of the substrate 1. The tip of the projected portion is sharpened. That is, the projected portion is projected upward (+Z direction) to a level higher than the top surface 32 of the first insulation layer 3. Accordingly, the projected portion can be defined as a portion of the cathode conductive film 10, the portion being positioned at a level higher than the level of the top surface 32 of the first insulation layer 3. The other end portion of the cathode conductive film 10 is connected to the cathode electrode 2.

The gate conductive film 12 is provided on a side surface 51 of the gate electrode 5 and on a top surface 52 of the gate electrode 5. A conductive member 13 at least including the gate electrode 5 and, if necessary, the gate conductive film 12, can be collectively referred to as a gate. The gate 13 including the gate electrode 5 (and the gate conductive film 12) faces the tip of the projected portion of the cathode conductive film 10 with a gap 11 between the gate 13 and the tip. The gap dimension of the gap 11 is represented by a symbol d (see FIGS. 1B and 2).

Figure 3:
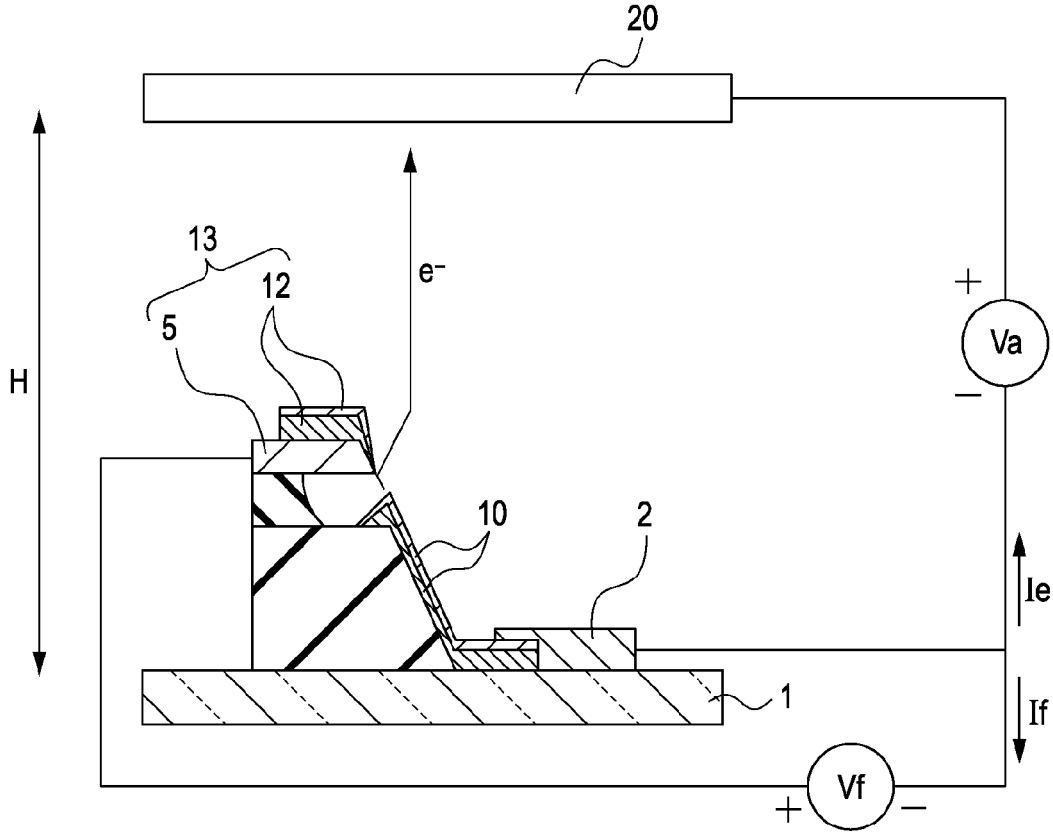
FIG. 3 is a schematic view of a configuration for determining characteristics of an electron-emitting device according to an embodiment of the present invention.

FIG. 3 illustrates the relationship between a power supply and potential when the electron emission characteristics of an electron-emitting device are determined. An anode electrode 20 made to have a potential higher than that of the gate electrode 5 is provided above the substrate 1. The anode electrode 20 is provided at a position farther than the gate electrode 5 with respect to the substrate 1. In FIG. 3, Vf represents voltage applied between the cathode electrode 2 and the gate electrode 5; If represents device current flowing through the gate electrode 5; Va represents voltage applied between the cathode electrode 2 and the anode electrode 20; and Ie represents electron emission current. Electron emission efficiency (η) is given by the following expression: Efficiency $\eta = Ie/(If+Ie)$ where current (If) is detected and current (Ie) is drawn into a vacuum when voltage (Vf) is applied to a device. As illustrated in FIG. 3, to drive an electron-emitting device, driving voltage Vf is applied between the cathode electrode 2 and the gate electrode 5 such that the potential of the gate electrode 5 is higher than the potential of the cathode electrode 2. As a result, a strong electric field is generated in the tip surface of the projected portion of the cathode conductive film 10, and electrons are field-emitted from the tip surface of the projected portion of the cathode conductive film 10. A portion of electrons emitted from the tip surface of the projected portion of the cathode conductive film 10 toward the gate 13 collides with the gate 13. Specifically, such electrons collide with the gate electrode 5 or the gate conductive film 12 on the gate electrode 5. The position with which emitted electrons often collide in the gate electrode 5 and the gate conductive film 12 is in the gate conductive film 12 on the side surface 51 of the gate electrode 5.

As described above, the gate electrode 5 (and the gate conductive film 12) should be provided so as to be away from the cathode conductive film 10 at a predetermined gap dimension d (gap 11) so that an electric field that can cause field emission can be applied to the cathode conductive film 10. When such an electric field can be applied with the gate electrode 5, the gate conductive film 12 is not necessarily provided on the gate electrode 5. To efficiently obtain field-emitted electrons, the gate 13 is provided at a level higher than the level of the cathode conductive film 10, that is, on a side closer to the anode electrode 20. The gate electrode 5 (and the gate conductive film 12) should be provided above the top surface 32 of the first insulation layer 3 by a predetermined distance (thickness of the second insulation layer 4). Stated another way, the second insulation layer 4 is a member that defines the distance between the gate electrode 5 (and the gate conductive film 12) and the top surface 32 of the first insulation layer 3.

Hereinafter, the projected portion of the cathode conductive film 10 will be described in terms of features and a desired form with reference to FIG. 2.

The tip of the projected portion of the cathode conductive film 10 includes a portion defined with radius r of curvature, the portion corresponding to a dotted circle in FIG. 2. Depending on the value of the radius r of curvature, the intensity of an electric field at the tip of the projected portion of the cathode conductive film 10 varies. The smaller the radius r is, the more electric lines of force are concentrated, which allows formation of an electric field having high intensity in the surface of the tip of the projected portion.

Thus, when the intensity of an electric field at the tip of the projected portion is made constant, there is the following relationship. When the radius r of curvature is relatively small, the gap dimension d between the tip of the projected portion of the cathode conductive film 10 and the gate 13 is large; and when the radius r is relatively large, the gap dimension d is small. The value of the gap dimension d influences the number of times scattering is caused, and hence, the larger the gap dimension d is, the higher the electron emission efficiency of an electron-emitting device is. However, when the gap dimension d is large, high driving voltage is required. In summary, to enhance the electron emission efficiency of an electron-emitting device, a method for producing an electron-emitting device in which the radius r can be made small and the gap dimension d can be controlled highly accurately is necessary.

Hereinafter, a method for producing an electron-emitting device according to the present embodiment will be described with an electron-emitting device having the above-described configuration serving as an example with reference to FIGS. 4A to 6B.

A series of steps in a production method according to the present embodiment will be briefly described and then the steps will be described in detail.

Step 1

Figure 4A:
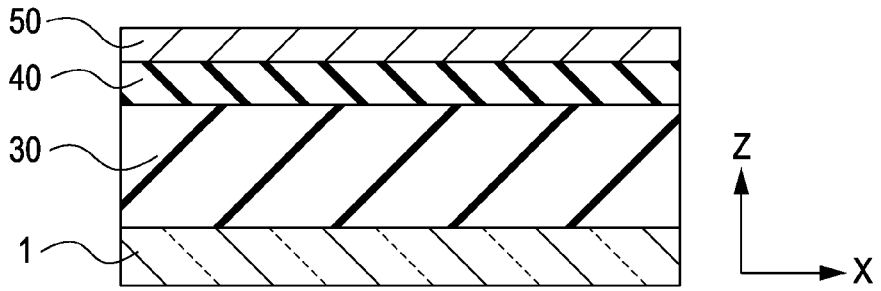
FIGS. 4A to 4C are schematic views of a method (Steps 1 to 3) for producing an electron-emitting device according to an embodiment of the present invention.

An insulation layer 30 to serve as the first insulation layer 3 is formed on a surface of the substrate 1. An insulation layer 40 to serve as the second insulation layer 4 is then formed on the top surface of the insulation layer 30. A conductive layer 50 to serve as the gate electrode 5 is subsequently formed on the top surface of the insulation layer 40 (FIG. 4A). A material for forming the insulation layer 40 is selected from materials other than a material for forming the insulation layer 30 such that the amount of the insulation layer 40 to be etched in a second etching treatment in Step 3 described below is larger than the amount of the insulation layer 30 to be etched in the second etching treatment.

Step 2

The conductive layer 50, the insulation layer 40, and the insulation layer 30 are then subjected to an etching treatment (first etching treatment). The first etching treatment is mainly intended to form the gate electrode 5 and the side surface 31 of the first insulation layer 3.

Figure 4B:
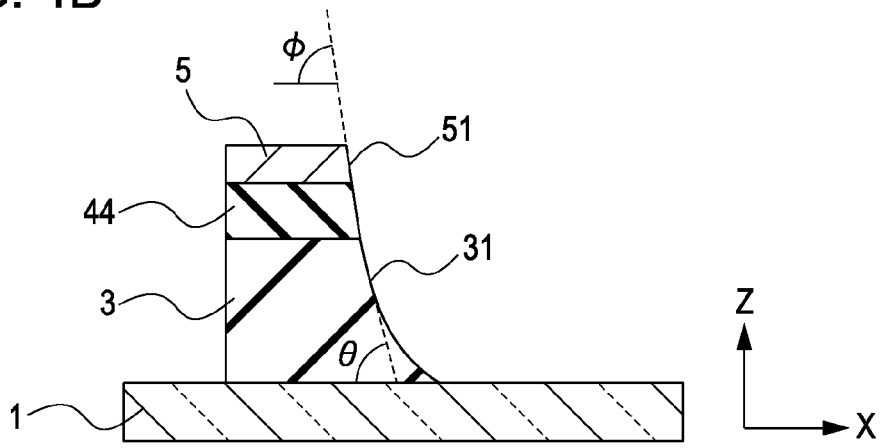

Specifically, the first etching treatment is conducted as follows: a resist pattern is formed on the conductive layer 50 by a photolithographic technique or the like, and then, the conductive layer 50, the insulation layer 40, and the insulation layer 30 are etched. As a result of Step 2, the first insulation layer 3 and the gate electrode 5 in the electron-emitting device illustrated in FIGS. 1A to 1C and the like are basically formed (FIG. 4B). As a result of Step 2, the insulation layer 40 to serve as the second insulation layer 4 has the shape of an insulation layer 44.

As illustrated in FIG. 4B and the like, it is desirable that the angle (θ) formed between the side surface (formed in Step 2) of the first insulation layer 3 and the surface of the substrate 1 be less than 90° to thereby provide an inclined surface.

Step 3

The insulation layer 44 formed in Step 2 is then subjected to an etching treatment (second etching treatment). The second etching treatment is mainly intended to form the recessed portion 42.

Figure 4C:
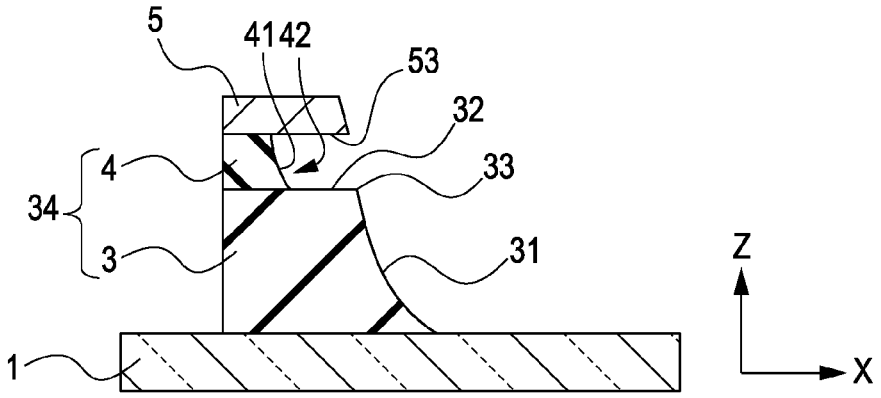

As a result of Step 3, the second insulation layer 4 in the electron-emitting device illustrated in FIGS. 1A to 1C and the like are basically formed. Thus, the recessed portion 42 is formed that is defined by the exposed top surface 32 of the first insulation layer 3, the side surface 41 of the second insulation layer 4, and the exposed bottom surface 53 of the gate electrode 5 (FIG. 4C). In Step 3, the side surface of the insulation layer 44 is etched, which exposes the top surface 32 of the first insulation layer 3. This results in the formation of the corner portion 33 along which the top surface 32 of the first insulation layer 3 and the side surface 31 of the first insulation layer 3 are connected to each other. The corner portion 33 may have a shape not having a curvature or a shape having a curvature. The angle formed between the top surface 32 of the first insulation layer 3 and the surface of the substrate 1 is smaller than the angle θ formed between the side surface 31 of the first insulation layer 3 and the surface of the substrate 1. Typically, the top surface 32 of the first insulation layer 3 and the surface of the substrate 1 are substantially parallel to each other.

Subsequently, steps for forming the cathode conductive film 10 (and the gate conductive film 12) will be described. Note that, in the following description, the side surface of the first insulation layer 3 is an inclined surface (inclined surface 31).

Step 4

Figure 5A:
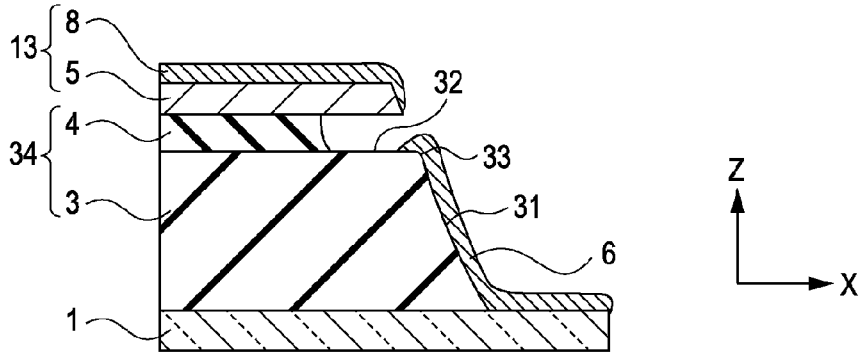
FIGS. 5A to 5C are schematic views of a method (Steps 4 to 6) for producing an electron-emitting device according to an embodiment of the present invention.

The first conductive film 6 is formed of a conductive material at least on the inclined surface 31 of the first insulation layer 3 (FIG. 5A). Step 4 is conducted such that the electrical conductivity of a portion of the cathode conductive film 10 on the inclined surface 31 is ensured even after a third etching treatment is conducted in Step 6 described below. As illustrated in FIG. 5A, the first conductive film 6 may be formed also on the top surface 32 of the first insulation layer 3 so as to extend into the recessed portion 42. When the first conductive film 6 is formed also on the top surface 32 of the first insulation layer 3, the first conductive film 6 is desirably formed so as to have a projected portion on the top surface 32.

For simplicity, in the following description, "a portion of the first conductive film 6 on the inclined surface 31 of the first insulation layer 3" is referred to as "the first conductive film 6 on the inclined surface 31". When "a portion of the first conductive film 6 on the top surface 32 of the first insulation layer 3" is provided, this portion is referred to as "the first conductive film 6 on the top surface 32".

In Step 4, the third conductive film 8 composed of the same material as the first conductive film 6 may be formed on the gate electrode 5 simultaneously when the first conductive film 6 is formed. However, the third conductive film 8 is not necessarily formed in Step 4.

As illustrated in FIG. 5A, in Step 4, the first conductive film 6 is desirably formed such that the first conductive film 6 is not in contact with the gate 13, which is a conductive member. That is, the first conductive film 6 is desirably formed such that the first conductive film 6 and the gate 13 are separated from each other with a gap therebetween. The "gate 13" referred to in Step 4 at least includes the gate electrode 5; and when the third conductive film 8 is formed, the "gate 13" in Step 4 includes the gate electrode 5 and the third conductive film 8. In summary, the first conductive film 6 is desirably formed such that the first conductive film 6 is not in contact with the gate electrode 5 or the third conductive film 8 (that is, in the state of being separated from the gate electrode 5 and the third conductive film 8).

In this way, the first conductive film 6 (and the third conductive film 8) is formed.

Step 5

Figure 5B:
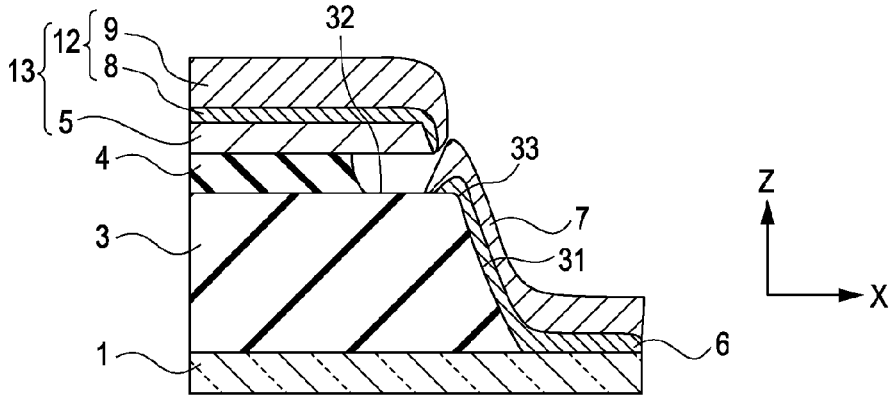

The second conductive film 7 is subsequently formed of a conductive material so as to extend from the top surface 32 of the first insulation layer 3 to the inclined surface 31 of the first insulation layer 3 (FIG. 5B). Step 5 is conducted such that a projected portion is formed on the top surface 32 (corner portion 33) of the first insulation layer 3. As described above, the top surface 32 and the inclined surface 31 of the first insulation layer 3 are connected to each other along the corner portion 33 and have different angles with respect to the surface of the substrate 1. For this reason, though the following will be described in detail below, formation of the projected portion on the top surface 32 results in that a portion of the second conductive film 7 on the top surface 32 of the first insulation layer 3 has a relatively high density (film density) compared with the film density of another portion of the second conductive film 7 on the inclined surface 31 of the first insulation layer 3. Stated another way, in Step 5, the second conductive film 7 is formed such that the portion on the top surface 32 of the first insulation layer 3 has a film density higher than the film density of the portion on the inclined surface 31 of the first insulation layer 3.

Since the first conductive film 6 is formed at least on the inclined surface 31 in Step 4, the first conductive film 6 at least underlies the portion of the second conductive film 7 on the inclined surface 31. Accordingly, the second conductive film 7 is provided on the first conductive film 6. Stated another way, the second conductive film 7 formed in Step 5 and the inclined surface 31 of the first insulation layer 3 sandwich therebetween the first conductive film 6 formed in Step 4.

When the first conductive film 6 is not formed on the top surface 32 of the first insulation layer 3 in Step 4, the portion of the second conductive film 7 on the top surface 32 of the first insulation layer 3 is not underlain by the first conductive film 6.

As illustrated in FIG. 5B, when the first conductive film 6 is formed also on the top surface 32 in Step 4, the second conductive film 7 is formed on the first conductive film 6 on the top surface 32 and on the first conductive film 6 on the inclined surface 31 so as to extend from the top surface 32 to the inclined surface 31. A configuration may be employed where the portion of the second conductive film 7 on the top surface 32 of the first insulation layer 3 is provided only on the first conductive film 6 on the top surface 32 and the second conductive film 7 is not in contact with the top surface 32. However, as illustrated in FIG. 5B, the second conductive film 7 desirably has a portion that is in contact with the top surface 32. That is, the second conductive film 7 is desirably formed so as to cover the first conductive film 6.

For simplicity, in the following description, "a portion of the second conductive film 7 on the inclined surface 31 of the first insulation layer 3" is referred to as "the second conductive film 7 on the inclined surface 31"; and "a portion of the second conductive film 7 on the top surface 32 of the first insulation layer 3" is referred to as "the second conductive film 7 on the top surface 32". The second conductive film 7 on the inclined surface 31" is at least underlain by "the first conductive film 6 on the inclined surface 31".

In Step 5, the fourth conductive film 9 composed of the same material as the second conductive film 7 is desirably formed on the gate electrode 5 or the third conductive film 8 simultaneously when the second conductive film 7 is formed.

In Step 5, there may be a case where the second conductive film 7 and the gate 13, which is a conductive member, are not in contact with each other. However, in Step 5, as illustrated in FIG. 5B, the second conductive film 7 is desirably formed so as to be in contact with the gate 13.

The "gate 13" referred to in Step 5 at least includes the gate electrode 5; and when the fourth conductive film 9 is formed, the "gate 13" in Step 5 includes the gate electrode 5 and the fourth conductive film 9. When the third conductive film 8 is formed in Step 4, the "gate 13" further includes the third conductive film 8. In summary, the second conductive film 7 is desirably formed such that the second conductive film 7 is (electrically) connected with the gate electrode 5. When the second conductive film 7 is made be in contact with at least any one of the gate electrode 5, the third conductive film 8, and the fourth conductive film 9, the second conductive film 7 is (electrically) connected with the gate electrode 5.

Typically, as illustrated in FIG. 5B, the second conductive film 7 and the fourth conductive film 9 are desirably formed so as to be in contact with each other. In a case, where the fourth conductive film 9 is composed of the same material as the second conductive film 7, the second conductive film 7 and the fourth conductive film 9 may be regarded as one continuous conductive film. But the one continuous conductive film can be expediently regarded as the second conductive film 7 on the first insulation layer 3 and the fourth conductive film 9 on the gate electrode 5 which are different from each other.

In this way, the second conductive film 7 (and the fourth conductive film 9) are formed.

Step 6

Figure 5C:
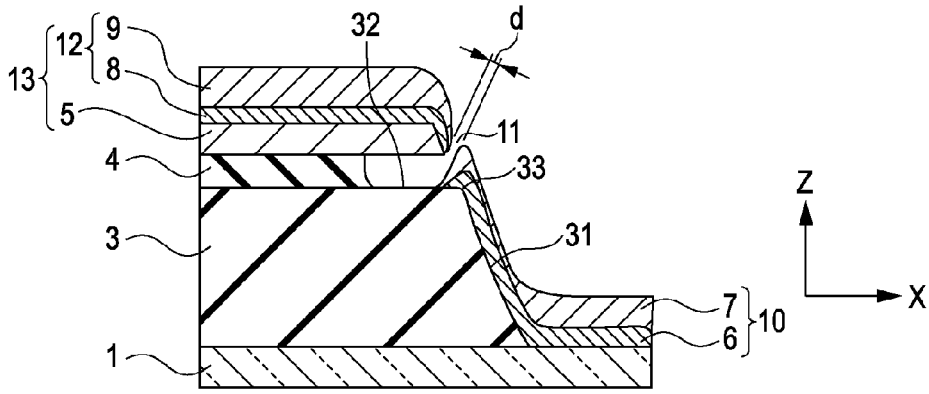

The second conductive film 7 is then subjected to an etching treatment (third etching treatment) (FIG. 5C).

By subjecting the second conductive film 7 to an etching treatment, the projected portion of the second conductive film 7 formed on the top surface 32 in Step 5 is sharpened. Thus, the efficiency of the electron-emitting device can be enhanced in Step 6.

In Step 6, unnecessary material of the second conductive film 7 having entered the recessed portion 42 in Step 5 is removed. As a result, residue of the conductive material in the recessed portion 42 is reduced to thereby enhance the reliability of the electron-emitting device.

Even when the second conductive film 7 is formed so as not to be in contact with the gate 13 in Step 5, the second conductive film 7 and the gate 13 may be in contact with each other in an unintended portion, which can cause a short-circuit defect or leakage current. Such a portion can be removed by the third etching treatment. As a result, the reliability of the electron-emitting device can be enhanced.

As a result of the third etching treatment, the gap 11 is formed between the second conductive film 7 and the gate 13 so as to have a desired gap dimension d. That is, the gap 11 for field emitting electrons can be formed. By forming the gap 11 with the third etching treatment, controllability over the gap dimension d of the gap 11 can be enhanced and the electron emission efficiency of the electron-emitting device can be enhanced. Since the gate 13 is a member at least including the gate electrode 5, it can also be stated that, as a result of the third etching treatment, a gap having a desired gap dimension is formed between the gate electrode 5 and the second conductive film 7. When the third conductive film 8 and/or the fourth conductive film 9 is formed, a gap having a desired gap dimension is also formed between these films and the second conductive film 7.

When the second conductive film 7 is formed so as to be in contact with the gate 13 in Step 5, as a result of the third etching treatment in Step 6, the second conductive film 7 and the gate 13 are separated from each other and the gap 11 having a desired gap dimension d is formed therebetween. Alternatively, the gap 11 can also be formed by forming the second conductive film 7 without such an etching treatment. However, by forming the gap 11 by etching the portions in contact with each other, the gap dimension d of the gap 11 can be controlled more accurately. As a result, the efficiency of the electron-emitting device can be enhanced. Typically, the second conductive film 7 is in contact with the fourth conductive film 9 in Step 5, and the second conductive film 7 is separated from the fourth conductive film 9 in Step 6 to thereby form a gap having a desired gap dimension.

The second conductive film 7 is formed in Step 5 such that the portion on the inclined surface 31 of the first insulation layer 3 has a film density lower than that of the portion on the top surface 32 of the first insulation layer 3.

The film density of the second conductive film 7 is inversely proportional to the etching rate of the second conductive film 7 in the third etching treatment, and a portion having a low film density is etched at a high etching rate (etched by a large amount). In the present invention, the term "etching rate" refers to the amount of decrease in the thickness of a film per unit of time caused by etching. In summary, in the third etching treatment, a low film-density portion of the second conductive film 7 is etched more than a high film-density portion of the second conductive film 7.

Figure 12A:
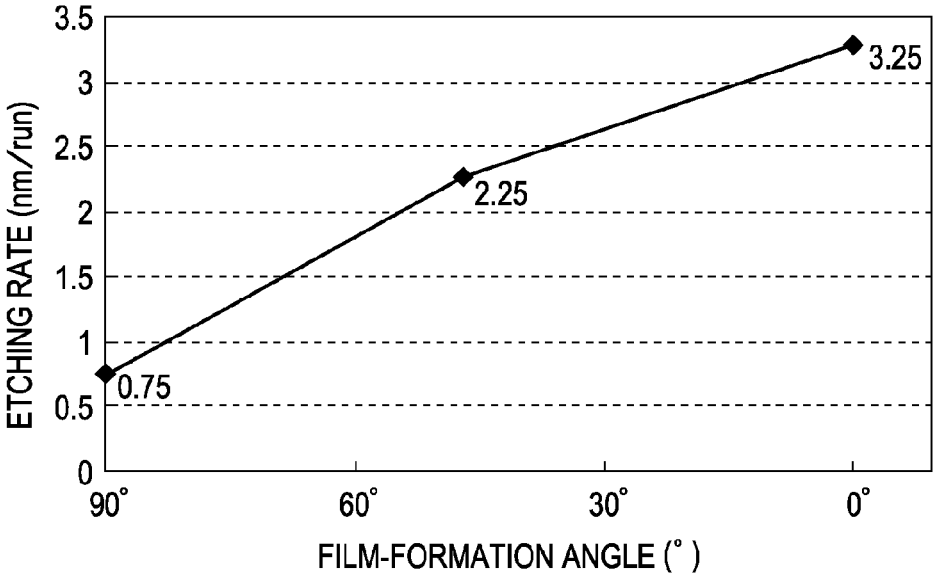
FIG. 12A is a graph showing the relationship between a film-formation angle and etching rate.

FIG. 12A shows the relationship between an angle at which a material for forming a molybdenum film was applied with respect to a surface on which the film was to be formed, and an etching rate at which the film formed at the application angle was etched under predetermined etching conditions. In FIG. 12A, etching for a certain period was defined as one run and the amount of decrease in the thickness of a film per run is illustrated instead of the amount of decrease in the thickness of a film per unit of time. The closer an angle at which a material for forming a film is applied with respect to a surface on which the film is to be formed is to 90°, the higher the film density of the resultant film is. The number of atoms removed by an etching treatment per unit of time is solely determined by the material being etched and etching conditions (etching method). Accordingly, film density and etching rate are in inverse proportion. Note that this relationship is not restricted to molybdenum and does not depend on the material of a film.

Thus, when the third etching treatment is conducted, the second conductive film 7 on the inclined surface 31 (this portion of the second conductive film 7 has a low film density) is etched at a higher etching rate than the second conductive film 7 on the top surface 32 (this portion of the second conductive film 7 has a high film density). Stated another way, when the second conductive film 7 on the inclined surface 31 and on the top surface 32 is simultaneously etched in Step 6, the amount of decrease in the thickness of the second conductive film 7 on the inclined surface 31 is larger than the amount of decrease in the thickness of the second conductive film 7 on the top surface 32. As a result, the electrical conductivity of the second conductive film 7, on the inclined surface 31, formed to have a relatively low film density in Step 5 described above is decreased (resistivity is increased).

However, in the present invention, as a result of Step 4 described above, the second conductive film 7 on the inclined surface 31 is at least underlain by the first conductive film 6 (the first conductive film 6 on the inclined surface 31). In this configuration, the electrical conductivity of a portion of the cathode conductive film 10 on the inclined surface 31 of the first insulation layer 3 can be ensured even after the third etching treatment is conducted. Stated another way, a decrease in the electrical conductivity of the cathode conductive film 10 caused by the third etching treatment is suppressed by the presence of the first conductive film 6. Thus, the first conductive film 6 formed on the inclined surface 31 in Step 4 has a function of suppressing a decrease in the electrical conductivity of the cathode conductive film 10.

As described above, according to the present embodiment, enhancement of the electron emission efficiency and enhancement of the reliability of the cathode conductive film 10 can be both achieved.

Figure 6A:
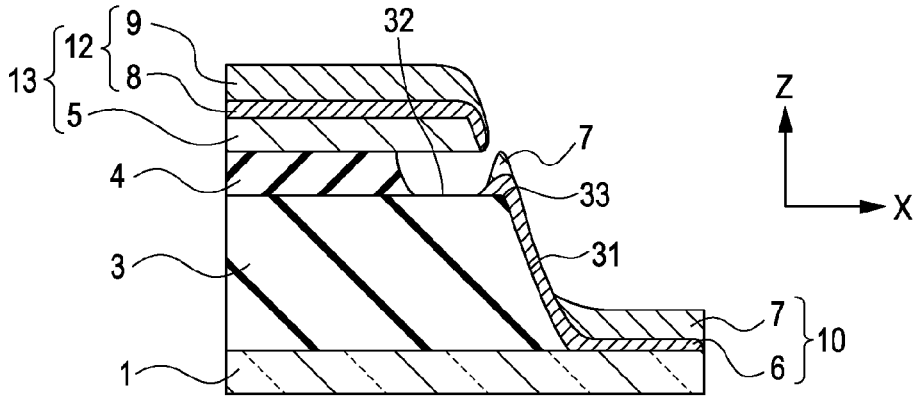
FIG. 6A is a schematic view of a method (Step 6) for producing an electron-emitting device according to another embodiment of the present invention.

In Step 6, by increasing the period for conducting etching or the number of times etching is repeated in the third etching treatment, the projected portion can be further sharpened as illustrated in FIG. 6A.

Step 7

Figure 6B:
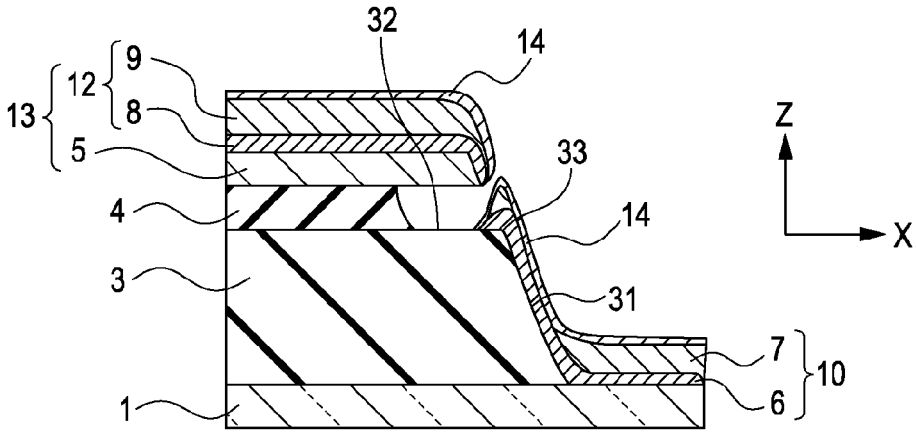
FIG. 6B is a schematic view of a method (Step 7) for producing an electron-emitting device according to an embodiment of the present invention.

After the cathode conductive film 10 is sharpened by the third etching treatment, a low work-function film 14 composed of a material having a work function lower than that of the cathode conductive film 10 can be formed on the cathode conductive film 10 (FIG. 6B). As a result of Step 7, the efficiency of electron emission characteristics can be enhanced. Step 7 may be eliminated.

Step 8

The cathode electrode 2 for feeding electrons to the cathode conductive film 10 is formed (FIG. 1A to 1C). Alternatively, Step 8 may be conducted before or after another Step. Note that the cathode conductive film 10 can have the function of the cathode electrode 2 without formation of the cathode electrode 2. In this case, Step 8 can be eliminated.

Hereinafter, each Step will be described in further detail.

Regarding Step 1

The substrate 1 may be composed of silica glass, glass having a reduced content of impurities such as Na, soda-lime glass, or the like. The substrate 1 needs to have not only high mechanical strength but also resistance to dry etching, wet etching, and alkali and acid serving as developers or the like. When the substrate 1 is used for an image display apparatus, the substrate 1 is subjected to a heating step and the like and hence the substrate 1 desirably has a thermal expansion coefficient that is not considerably different from the thermal expansion coefficients of members to be stacked on the substrate 1. In consideration of a heat treatment, the substrate 1 is desirably composed of a glass material from which an alkaline element or the like is less likely to disperse into an electron-emitting device.

The insulation layer 30 (first insulation layer 3) is composed of an insulation material having high processability, for example, silicon nitride (typically $Si_3N_4$) or silicon oxide (typically $SiO_2$). The insulation layer 30 can be formed by a general vacuum film-formation method such as a sputtering method, a CVD method, or a vacuum deposition method. The insulation layer 30 is made to have a thickness in the range of several nanometers to several tens of micrometers, desirably in the range of several tens of nanometers to several hundreds of nanometers.

The insulation layer 40 (second insulation layer 4) is composed of an insulation material having high processability, for example, silicon nitride (typically $Si_3N_4$) or silicon oxide (typically $SiO_2$). The insulation layer 40 can be formed by a general vacuum film-formation method such as a sputtering method, a CVD method, or a vacuum deposition method. The insulation layer 40 is made to have a thickness smaller than that of the insulation layer 30 and in the range of several nanometers to several hundreds of nanometers, desirably in the range of several nanometers to several tens of nanometers.

After the insulation layer 30 and the insulation layer 40 are stacked on the substrate 1, the recessed portion 42 needs to be formed in Step 3. For this reason, the insulation layer 30 and the insulation layer 40 are formed such that the amount of the insulation layer 40 to be etched in the second etching treatment is larger than the amount of the insulation layer 30 to be etched in the second etching treatment. In the second etching treatment, the ratio of the amount of the insulation layer 40 to be etched to the amount of the insulation layer 30 to be etched is desirably 10 or more, more desirably, 50 or more.

To achieve such a ratio in terms of amount to be etched, for example, the insulation layer 30 is formed of silicon nitride while the insulation layer 40 is formed of silicon oxide. Alternatively, the insulation layer 30 is formed of silicon nitride while the insulation layer 40 is formed of PSG (phosphorus silicate glass) having a high phosphorus concentration, BSG (boron silicate glass) having a high boron concentration, or the like.

The conductive layer 50 (gate electrode 5) has electrical conductivity and is formed by a general vacuum film-formation method such as a deposition method or a sputtering method.

The conductive layer 50 to serve as the gate electrode 5 is desirably composed of a material having electrical conductivity, high thermal conductivity, and a high melting point. Such a material is, for example, a metal or an alloy of Be, Mg, Ti, Zr, Hf, V, Nb, Ta, Mo, W, Al, Cu, Ni, Cr, Au, Pt, or Pd; a carbide, a boride, a nitride, or a semiconductor composed of Si, Ge, or the like.

The conductive layer 50 (gate electrode 5) is made to have a thickness in the range of several nanometers to several hundreds of nanometers, desirably in the range of several tens of nanometers to several hundreds of nanometers.

Since the conductive layer 50 to serve as the gate electrode 5 may be made to have a thickness smaller than the thickness of the cathode electrode 2, the conductive layer 50 is desirably composed of a material having a resistance lower than that of the material of the cathode electrode 2.

Regarding Step 2

The first etching treatment is desirably conducted by RIE (reactive ion etching) in which etching gas is turned into plasma and radiated to a material to thereby permit precise etching of the material.

As for a gas used for RIE, when a member to be etched is composed of a material that can turn into a fluoride, a fluorine-based gas such as $CF_4$, $CHF_3$, or $SF_6$ is selected. When a member to be etched is composed of a material such as Si or Al that can turn into a chloride, a chlorine-based gas such as $Cl_2$ or $BCl_3$ is selected. To achieve a sufficiently high selectivity ratio between a material to be etched and resist, to ensure the flatness of an etched surface, or to increase etching speed, at least one of hydrogen, oxygen, and argon gas is desirably added to an etching gas.

As a result of Step 2, the same or substantially the same shapes as in the first insulation layer 3 and the gate electrode 5 in the electron-emitting device illustrated in FIGS. 1A to 1C and the like are basically formed. However, this does not mean that the first insulation layer 3 and the gate electrode 5 are not etched at all in an etching treatment to be conducted after Step 2.

The angle (illustrated as θ in FIG. 4B) formed between the side surface 31 of the first insulation layer 3 and the surface of the substrate 1 can be controlled to be a desired value by controlling conditions such as the type of a gas or pressure. The angle θ is desirably controlled to be less than 90°. That is, the side surface 31 of the first insulation layer 3 is desirably an inclined surface. This is because the film quality (film density) of the second conductive film 7 to be formed on the side surface 31 of the first insulation layer 3 in Step 5 can be controlled. Additionally, by making the angle θ less than 90°, the side surface 51 (on the cathode electrode side) of the gate electrode 5 becomes more recessed than the side surface 31 (on the cathode electrode side) of the first insulation layer 3, that is, the side surface 51 is positioned in the −X direction with respect to the side surface 31. As illustrated in FIG. 4B, the side surface 31 of the first insulation layer 3 may be a curved surface. In this case, the angle θ of the side surface 31 can be defined as the maximum angle formed between a tangent of the side surface 31 and the surface of the substrate 1.

Since the corner portion 33 is formed as described above, the angle formed between the top surface 32 of the first insulation layer 3 and the surface of the substrate 1 is smaller than the angle θ formed between the side surface 31 and the surface of the substrate 1. Since the first insulation layer 3 is formed on the surface of the substrate 1 by a commonly used film-formation method, the top surface 32 of the first insulation layer 3 is substantially parallel to the surface of the substrate 1. Specifically, there may be a case where the top surface 32 of the first insulation layer 3 is completely parallel to the surface of the substrate 1 and a case where the top surface 32 of the first insulation layer 3 is slightly inclined with respect to the surface of the substrate 1 due to environments, conditions, or the like in film formation. Both of these cases are understood to be in the scope of "substantially parallel".

An angle (illustrated as ϕ in FIG. 4B) formed between the side surface 51 of the gate electrode 5 and the surface of the substrate 1 is also determined depending on conditions of the first etching treatment. The angle ϕ is desirably made be less than 90°. Additionally, the angle ϕ is desirably made be less than the angle θ. There may be a case where the side surface 51 of the gate electrode 5 is a curved surface. In this case, the angle ϕ of the side surface 51 can be defined as the maximum angle formed between a tangent of the side surface 51 and the surface of the substrate 1.

Regarding Step 3

In Step 3, an etchant is selected such that the amount of the first insulation layer 3 to be etched by the etchant is considerably smaller than the amount of the insulation layer 44 to be etched by the etchant. That is, the second etching treatment is conducted by wet etching process.

The second etching treatment may be conducted with, for example, an etchant of commonly called buffered hydrofluoric acid (BHF) when the insulation layer 44 (second insulation layer 4) is composed of silicon oxide and the insulation layer 30 (first insulation layer 3) is composed of silicon nitride. The buffered hydrofluoric acid (BHF) is a mixed solution of ammonium fluoride and hydrofluoric acid. Alternatively, when the insulation layer 44 (second insulation layer 4) is composed of silicon nitride and the insulation layer 30 (first insulation layer 3) is composed of silicon oxide, the second etching treatment may be conducted with a hot phosphoric acid-based etchant.

As a result of Step 3, the same or substantially the same shape as in the second insulation layer 4 in the electron-emitting device illustrated in FIGS. 1A to 1C and the like is formed. However, this does not mean that the second insulation layer 4 is not etched at all in an etching treatment to be conducted after Step 3.

The depth of the recessed portion 42 (the distance in the X direction in which the insulation layer 44 is etched) considerably relates to leakage current occurring in the electron-emitting device. The deeper the recessed portion 42 is formed, the smaller leakage current occurring becomes. However, when the recessed portion 42 is formed to have an excessively large depth, problems such as deformation of the gate electrode 5 may be caused. For this reason, the recessed portion 42 is practically made to have a depth of 30 nm or more and 200 nm or less. Stated another way, the depth of the recessed portion 42 is a distance from the corner portion 33 of the first insulation layer 3 to the side surface 41 of the second insulation layer 4.

An example where the step-forming member 34 is constituted by the stack of the first insulation layer 3 and the second insulation layer 4 has been described so far. Alternatively, the step-forming member 34 may also be constituted by three or more layers. Specifically, another insulation layer may be further formed on the second insulation layer 4 defining the recessed portion 42. For example, such an insulation layer formed on the second insulation layer 4 may be composed of the same material as that of the first insulation layer 3. In this case, the bottom surface 53 of the gate electrode 5 is not exposed in the configuration obtained as a result of Step 3. Whatever the case may be, the gate electrode 5 is provided above the top surface 32 of the first insulation layer 3.

Regarding Step 4

In Step 4, a material for forming the first conductive film 6 (and the third conductive film 8) is not particularly restricted and any material having electrical conductivity may be used. Such a material is, for example, a metal or an alloy of Be, Mg, Ti, Zr, Hf, V, Nb, Ta, Mo, W, Al, Cu, Ni, Cr, Au, Pt, or Pd; a carbide, a boride, or a nitride.

The portion of the first conductive film 6 on the inclined surface 31 desirably has high resistance (etching resistance) to the third etching treatment to be conducted in Step 6. Specifically, by an etching method used in the third etching treatment, the portion of the first conductive film 6 on the inclined surface 31 is etched at an etching rate lower than that in the portion of the second conductive film 7 on the inclined surface 31.

Hereinafter, a reason for this will be described.

As described above, when the second conductive film 7 is formed so as to have the projected portion on the corner portion 33 (top surface 32), the second conductive film 7 on the inclined surface 31 has a low film density whereas the second conductive film 7 on the top surface 32 has a relatively high film density.

As described above in the section "Step 6", film density and etching rate is in inverse proportion. Accordingly, in the third etching treatment in Step 6, the portion of the second conductive film 7 on the inclined surface 31, the portion having a low film density, is etched more and the amount of decrease in the film thickness of the portion is large. In the present invention, the portion of the second conductive film 7 on the inclined surface 31 is underlain by the first conductive film 6. In this configuration, even after the portion of the second conductive film 7 on the inclined surface 31 is etched by the third etching treatment, the projected portion of the second conductive film 7 corresponding to an electron emission portion and the cathode electrode 2 on the inclined surface 31 can be connected stably to each other.

When the entirety of or a part of the portion of the second conductive film 7 on the inclined surface 31 is removed (the film thickness of the portion becomes zero) by the third etching treatment, the first conductive film 6 is exposed and directly subjected to the third etching treatment.

When the second conductive film 7 is subjected to the third etching treatment in Step 6, there may be the case where the second conductive film 7 does not completely cover the first conductive film 6 in portions such as pin holes or cracks. In this case, there is a possibility that the first conductive film 6 is influenced by the third etching treatment. In such a case, the first conductive film 6 is also in the state of being exposed and directly subjected to the third etching treatment.

When the first conductive film 6 has low etching resistance and the first conductive film 6 is influenced by the third etching treatment or directly subjected to the third etching treatment as described above, there is a possibility that the first conductive film 6 is etched. When the first conductive film 6 is readily etched, the electrical conductivity of the cathode conductive film 10 is decreased and the reliability of the electron-emitting device is degraded.

For this reason, as described above, by enhancing the etching resistance of the portion of the first conductive film 6 on the inclined surface 31, the electrical conductivity of the cathode conductive film 10 on the inclined surface 31 can be ensured more stably.

The relationship of the first conductive film 6 and the second conductive film 7 in terms of film thickness and etching rate desirably provides the state that, when the second conductive film 7 on the top surface 32 is entirely etched in the film thickness direction, the cathode conductive film 10 remains on the inclined surface 31.

Specifically, the relationship of the first conductive film 6 and the second conductive film 7 in terms of film thickness and etching rate in the third etching treatment desirably satisfies the following conditional expression.

$$T_{1s}/E_{1s}+T_{2s}/E_{2s} \geqq T_{2t}/E_{2t} \quad \text{conditional expression}$$

Figure 7:
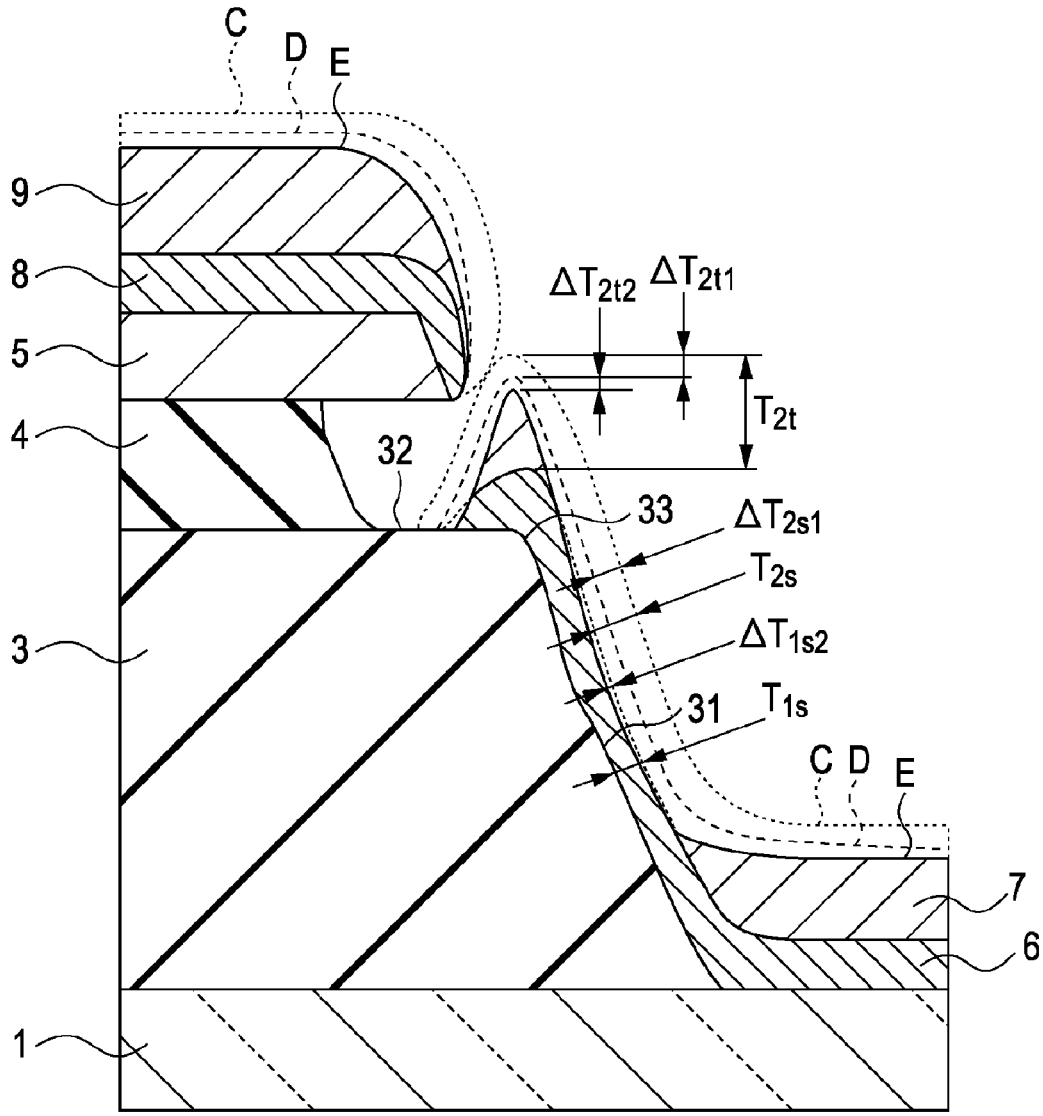
FIG. 7 is an explanatory view of Step 6 according to an embodiment of the present invention.

In this expression, $T_{1s}$ represents the thickness of the first conductive film 6 on the inclined surface 31; $E_{1s}$ represents an etching rate of the first conductive film 6 on the inclined surface 31 with respect to the third etching treatment; $T_{2s}$ represents the thickness of the second conductive film 7 on the inclined surface 31; $E_{2s}$ represents an etching rate of the second conductive film 7 on the inclined surface 31 with respect to the third etching treatment; $T_{2t}$ represents the thickness of the second conductive film 7 on the top surface 32; and $E_{2t}$ represents an etching rate of the second conductive film 7 on the top surface 32 with respect to the third etching treatment. Herein, these etching rates $E_{1s}$, $E_{2s}$, and $E_{2t}$ are solely determined by the relationships between characteristics of the films (for example, materials of the films and the density of the films) and the method of the third etching treatment (for example, the type of an etchant). Accordingly, the conditional expression is valid regardless of whether or not the first conductive film 6 on the inclined surface 31 is etched in the third etching treatment. Although the following will be specifically described in a section "Regarding Step 6" below, FIG. 7 illustrates the relationship of the first conductive film 6 and the second conductive film 7 in terms of film thickness and variation in film thickness in Step 6. Each etching rate in the expression is obtained by dividing variation in film thickness by the time for which the etching treatment is conducted. When the conditional expression is satisfied, the electrical conductivity of the cathode conductive film 10 on the inclined surface 31 is ensured even when the first conductive film 6 on the inclined surface 31 is exposed in Step 6. Note that, even when the conditional expression is satisfied, the first conductive film 6 on the inclined surface 31 desirably has high etching resistance. Specifically, $E_{1s}<E_{2s}$ is desirably satisfied.

In the present invention, the first conductive film 6 is desirably composed of a material such as TaN or Ta. When the first conductive film 6 is composed of the same material as that of the second conductive film 7, the first conductive film 6 is desirably a film having a film density higher than that of the second conductive film 7 on the inclined surface 31.

Hereinafter, techniques for enhancing the etching resistance of the first conductive film 6 will be described.

The first conductive film 6 is desirably composed of a material that has etching resistance higher (is etched at an etching rate lower) than that of the second conductive film 7 in the third etching treatment and is different from the material of the second conductive film 7. Stated another way, the combination of the material of the first conductive film 6, the material of the second conductive film 7, and conditions of the third etching treatment are desirably determined in Steps 4 to 6 so as to satisfy the above-described conditional expression.

Another desirable technique is to make the film density of the first conductive film 6 on the inclined surface 31 higher than that of the second conductive film 7 on the inclined surface 31. This technique can be desirably used particularly when the first conductive film 6 and the second conductive film 7 are composed of the same material. Although the following will be specifically described in a section "Regarding Step 5" below, a film having a high density can be formed on the inclined surface 31 by a film formation technique having directivity such that the material of the first conductive film 6 is made adhere to the inclined surface 31 in a direction closer to the direction perpendicular to the inclined surface 31.

When the first conductive film 6 is formed also on the top surface 32 in Step 4, the first conductive film 6 is desirably formed such that the first conductive film 6 on the inclined surface 31 has a film density higher than that of the first conductive film 6 on the top surface 32. In this case, the first conductive film 6 can also be formed by a film formation technique having directivity such that the material of the first conductive film 6 is made adhere to the inclined surface 31 in a direction closer to the direction perpendicular to the inclined surface 31. Since film density and resistivity are in inverse proportion and film density and etching rate are in inverse proportion, such film formation can further enhance the electrical conductivity and etching resistance of the first conductive film 6 on the inclined surface 31.

Regarding Step 5

In Step 5, the material of the second conductive film 7 should be selected from materials having electrical conductivity and allowing field emission, desirably from materials having a high melting point of 2000° C. or more. The second conductive film 7 is desirably formed of a material that has a work function of 5 eV or less and whose oxide can be readily etched off. Such a material is, for example, a metal or an alloy of Hf, V, Nb, Ta, Mo, W, Au, Pt, or Pd; a carbide, a boride, or a nitride. In particular, Mo or W is desirably used.

The second conductive film 7 can be formed by a vacuum film-formation method such as a sputtering method or a deposition method. As described above, the second conductive film 7 is desirably formed in Step 5 such that the second conductive film 7 on the top surface 32 has a film density higher than the film density of the second conductive film 7 on the inclined surface 31.

To perform such film formation, the second conductive film 7 is formed by a film formation technique having directivity such as a directional sputtering method or a deposition method. Use of a film formation technique having directivity allows control of an angle at which the material of the second conductive film 7 is applied to the top surface 32 and the inclined surface 31 of the first insulation layer 3 (and the top surface 52 and the side surface 51 of the gate electrode 5).

When a directional sputtering method is conducted, for example, the angle between the substrate 1 and a target is set and another arrangement is conducted in which a shielding plate is provided between the substrate 1 and the target, the distance between the substrate 1 and the target is set at about the mean free path of sputtering particles, or the like. A collimated sputtering method in which a collimator imparting directivity to sputtering particles may also be used as a directional sputtering method. In this way, sputtering particles serving as a material for forming a film are applied to the substrate 1 (typically the top surface 32 and the inclined surface 31 of the first insulation layer 3) at restricted angles. The term "sputtering particles" refers to atoms being sputtered from a target or particles being sputtered from a target.

Specifically, the angle at which sputtering particles serving as a film formation material are applied to the inclined surface 31 of the first insulation layer 3 is made smaller than the angle at which the sputtering particles serving as the film formation material are applied to the top surface 32 (corner portion 33) of the first insulation layer 3. Note that the angle at which the sputtering particles are applied to the top surface 32 (corner portion 33) of the first insulation layer 3 is made closer to 90° than the angle at which the sputtering particles are applied to the inclined surface 31 of the first insulation layer 3. In this way, the sputtering particles can be applied to the top surface 32 (corner portion 33) of the first insulation layer 3 more perpendicularly than to the inclined surface 31 of the first insulation layer 3. As a result, the second conductive film 7 on the top surface 32 has a film density higher than that of the second conductive film 7 on the inclined surface 31. As a result of such film formation, as described above, the second conductive film 7 on the top surface 32 (corner portion 33) of the first insulation layer 3 can be made to have a projected profile (projected portion).

When a film is formed by a deposition method in a high vacuum at a degree of vacuum of about $10^{-2}$ to $10^{-4}$ Pa, a vaporized material serving as a film formation material and being vaporized from a vaporization source has a low probability of collision. Additionally, since such a vaporized material has a mean free path of about several hundreds of millimeters to several meters, the vaporized material is applied to a substrate while the directivity of the vaporized material upon vaporization from the vaporization source is maintained. Thus, a deposition method is also a film formation method having directivity. A technique used for vaporizing such a vaporization source is, for example, resistance heating, high-frequency induction heating, electron beam heating, or the like. However, in view of the range of usable materials and the area to be heated, a technique of using electron beams is desirable.

When the second conductive film 7 is formed of molybdenum, the second conductive film 7 on the top surface 32 desirably has a density (film density) of 9.5 g/cm$^3$ or more and 10.2 g/cm$^3$ or less, and the second conductive film 7 on the inclined surface 31 desirably has a density (film density) of 7.5 g/cm$^3$ or more and 8.0 g/cm$^3$ or less.

Figure 12B:
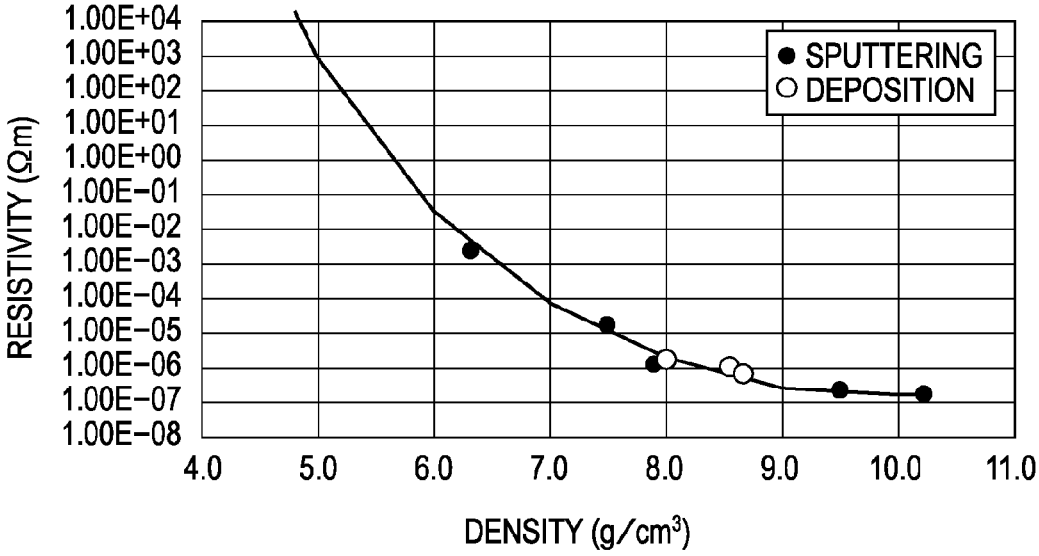
FIG. 12B is a graph showing the relationship between the film density and the resistivity of a film.

These ranges are practically set in consideration of resistivity, film thickness (since the low-density film is formed on the inclined surface, the low-density film portion has a small thickness with respect to the inclined surface), and the difference in etching rates in terms of the films. FIG. 12B shows the relationship between the film density and the resistivity of a molybdenum film. As is clear from FIG. 12B, the film density and the resistivity of a metal film are generally in inverse proportion. For this reason, as a result of Step 5, the second conductive film 7 is formed to have a projected portion on the top surface 32 (corner portion 33) and the projected portion has high electrical conductivity, which is advantageous.

In general, film density is determined by XRR (X-ray reflectometry); however, there is a case where it is difficult to determine film density in an actual electron-emitting device. In such a case, film density may be determined by, for example, the following technique. The density of a film (target film) can be obtained by analyzing atoms of the target film quantitatively with a high-resolution electron energy loss spectroscopy electron microscope in which a transmission electron microscope (TEM) is combined with electron energy loss spectroscopy (EELS), and calculating the density of the target film on the basis of a calibration curve by comparison of the analytical result with the analytical result of a film having a known film density.

As described above, by making the angle θ less than 90° in Step 2, the side surface 51 (on the cathode electrode 2 side) of the gate electrode 5 is more recessed than the side surface 31 (on the cathode electrode 2 side) of the first insulation layer 3. Thus, as a result of the above-described directional film formation in Step 5, a projected portion constituted by a film having a density higher than that of the film on the inclined surface 31 is formed on the top surface 32 (corner portion 33).

Accordingly, by making the angle θ formed by the first etching treatment in Step 2 smaller, the second conductive film 7 can be formed in larger area on the top surface 32 of the first insulation layer 3. Stated another way, by making the side surface 51 (on the cathode electrode 2 side) of the gate electrode 5 more recessed with respect to the side surface 31 (on the cathode electrode 2 side) of the first insulation layer 3, the second conductive film 7 having a larger high-density portion can be formed on the top surface 32 of the first insulation layer 3. In this case, the entry distance x of the cathode conductive film 10 can also be increased.

The fourth conductive film 9 is desirably composed of the same material as the second conductive film 7. The fourth conductive film 9 and the second conductive film 7 are desirably simultaneously formed in Step 5.

As described above, the second conductive film 7 is formed in Step 5 such that the second conductive film 7 on the top surface 32 has a film density higher than that of the second conductive film 7 on the inclined surface 31. When the film formation method is used, similar situation also occurs for the fourth conductive film 9 on the gate electrode 5.

Specifically, by forming the gate electrode 5 in Step 2 such that the angle ϕ formed between the side surface 51 of the gate electrode 5 and the substrate 1 is smaller than the angle θ, the angle ϕ of the side surface 51 of the gate electrode 5 is made close to the angle of the top surface 32 of the first insulation layer 3. The fourth conductive film 9 on the side surface 51 of the gate electrode 5 is a portion with which electrons emitted from the cathode conductive film 10 can initially collide. The fourth conductive film 9 on the side surface 51 of the gate electrode 5 has film quality similar to the film quality of the second conductive film 7 on the top surface 32 and has high film density.

As described above, the film density and the resistivity of a metal film are generally in inverse proportion. For this reason, by making the angle ϕ smaller than the angle θ, the electrical conductivity of the gate conductive film 12 on the side surface 51 of the gate electrode 5 can be enhanced, the gate conductive film 12 corresponding to a portion with which electrons emitted from the cathode conductive film 10 can initially collide.

In summary, by providing a configuration where the angle ϕ formed between the side surface 51 of the gate electrode 5 and the substrate 1 is smaller than the angle θ, the reliability of the electron-emitting device is enhanced.

In Step 5, the second conductive film 7 and the gate 13 (a member at least including the gate electrode 5 and, in some cases, further including at least one of the third conductive film 8 and the fourth conductive film 9) are not necessarily in contact with each other. Stated another way, the second conductive film 7 and the fourth conductive film 9 may be formed in Step 5 such that a gap is formed therebetween.

However, as illustrated in FIG. 2, the gap 11 having a gap dimension d between the cathode conductive film 10 and the gate 13 needs to be formed with high accuracy in an electron-emitting device. In particular, when a plurality of electron-emitting devices are formed with high uniformity, it is important to decrease variation in the size of the gaps 11 of the electron-emitting devices. To control the size (gap dimension d) of the gap 11 with higher accuracy, the second conductive film 7 is desirably formed in Step 5 so as to be in contact with the gate 13. After Step 5, the third etching treatment is conducted in Step 6 such that the gap 11 is formed between the second conductive film 7 and the gate 13. More desirably, the second conductive film 7 and the fourth conductive film 9 are formed so as to be in contact with each other.

When the gap is formed in Step 4 by, for example, controlling the time for film formation or conditions for film formation, there is also a possibility that a portion at which the second conductive film 7 and the gate 13 are substantially in contact with each other (short-circuit defect) is formed. For this reason, after Step 5, the third etching treatment needs to be conducted in Step 6.

Regarding Step 6

The third etching treatment may be conducted by dry etching or wet etching. However, in consideration of ease of controlling a selectivity ratio between a target material and another material, wet etching with an etchant is desirably conducted.

Since the gap dimension d of the gap 11 is desirably small of about several nanometers, in consideration of controllability of the amount to be etched, an etching rate is desirably 1 nm or less per minute.

Referring to FIG. 7, forming of the gap 11 and sharpening of the projected portion of the second conductive film 7 will be described.

A dotted line C in FIG. 7 represents the surface of the first conductive film 6 in the state where the first conductive film 6 (and the third conductive film 8) is formed in Step 4. The dotted line C in FIG. 7 also represents the surface of the second conductive film 7 (and the fourth conductive film 9) in the state where the second conductive film 7 (and the fourth conductive film 9) is formed in Step 5. In Step 4, the first conductive film 6 having a thickness $T_{1s}$ is formed at least on the inclined surface 31. In Step 5, sputtering particles are flown and applied at an angle close to 90° with respect to the corner portion 33 of the first insulation layer 3, the top surface 32 of the first insulation layer 3, and the top surface 52 of the gate electrode 5 by a film formation method having directivity. As a result, the second conductive film 7 having the film thickness $T_{2t}$ and high density is formed on the top surface 32. In contrast, since the sputtering particles are applied at lower angles with respect to the inclined surface 31 of the first insulation layer 3 and the side surface 51 of the gate electrode 5, the second conductive film 7 having the film thickness $T_{2s}$ and low density is formed on these surfaces.

A dashed line D in FIG. 7 represents the surface of the second conductive film 7 (and the fourth conductive film 9) in the state where the third etching treatment has been conducted in Step 6. In FIG. 7, $\Delta T_{2t1}$ represents the amount of decrease in the film thickness in the high film-density portion of the second conductive film 7 on the top surface 32, the decrease being caused by the third etching treatment. $\Delta T_{2s1}$ represents the amount of decrease in the film thickness in the low film-density portion of the second conductive film 7 on the inclined surface 31, the decrease being caused by the third etching treatment. As described above, the film density and the etching rate of a film is in inverse proportion. For this reason, in the third etching treatment, the portion of the second conductive film 7 on the inclined surface 31 is etched at a high etching rate compared with the portion of the second conductive film 7 on the top surface 32. Stated another way, the amount of decrease in the thickness of the second conductive film 7 in the third etching treatment according to the present embodiment satisfies the following relationship: $\Delta T_{2t1}<\Delta T_{2s1}$. As illustrated in FIG. 7, when the second conductive film 7 and the gate 13 (fourth conductive film 9) are in contact with each other in Step 5, the second conductive film 7 and the gate 13 (fourth conductive film 9) are separated from each other by the third etching treatment.

The amount of decrease in film thickness due to the third etching treatment can be controlled by changing the period for conducting the etching and/or the number of times the etching is conducted. As illustrated in FIG. 6A, by increasing the period for conducting the etching and/or the number of times the etching is conducted, the projected portion can be further sharpened. This treatment of sharpening the projected portion is referred to as "sharpening treatment" for convenience of description. Note that the sharpening is achieved by conducting the third etching treatment and the sharpening does not necessarily refer only to increasing of the number of times the etching is conducted and/or increasing of the period for conducting the etching. As for such a sharpening treatment, in particular, the number of times the third etching treatment is conducted is desirably increased (the third etching treatment is repeated) to control the gap dimension of the gap with high accuracy.

An example will be described where the thickness of the second conductive film 7 is decreased in the top surface 32 and the inclined surface 31 respectively by $\Delta T_{2t1}$ and $\Delta T_{2s1}$ due to the third etching treatment as described above, and then a sharpening treatment is further conducted.

A solid line E in FIG. 7 represents the state where the third etching treatment (sharpening treatment) has been further conducted from the state represented by the dashed line. In FIG. 7, $\Delta T_{2t2}$ represents the amount of decrease in the film thickness of the high film-density portion of the second conductive film 7 on the top surface 32, the decrease being caused by the sharpening treatment. $\Delta T_{1s2}$ represents the amount of decrease in the film thickness of the first conductive film 6 on the inclined surface 31, the decrease being caused by the sharpening treatment. In this state illustrated in FIG. 7, the first conductive film 6 on the inclined surface 31 is exposed. That is, the thickness of the second conductive film 7 on the inclined surface 31 is decreased by the sharpening treatment by $T_{2s}-\Delta T_{2s1}$.

In contrast, the amount of decrease in the thickness of the second conductive film 7 on the top surface 32 due to the sharpening treatment is $\Delta T_{2t2}$. As described above, the portion of the second conductive film 7 on the inclined surface 31 is etched at a high etching rate compared with the portion of the second conductive film 7 on the top surface 32. Accordingly, the following relationship is satisfied: $\Delta T_{2t2}<T_{2s}-\Delta T_{2s1}$. As a result, the projected portion is sharpened.

In the case where the first conductive film 6 has high resistance to the third etching treatment, even when the first conductive film 6 on the inclined surface 31 is exposed by a sharpening treatment, the amount of decrease $\Delta T_{1s2}$ in the film thickness of the first conductive film 6 on the inclined surface 31 is small. Accordingly, the electrical conductivity of the cathode conductive film 10 on the inclined surface 31 is ensured.

Although a part of the second conductive film 7 is no longer present on the inclined surface 31 in FIGS. 6A and 6B, the second conductive film 7 may be remained partially on the inclined surface 31 or so as to cover the inclined surface 31. Whatever the case may be, since the first conductive film 6 is formed on the inclined surface 31 in Step 4, the electrical conductivity of the cathode conductive film 10 on the inclined surface 31 is ensured.

Accordingly, an electron-emitting device having high reliability and high efficiency can be obtained in which the cathode conductive film 10 on the inclined surface 31 has high electrical conductivity and the projected portion is sharpened.

The combination of the material for forming the second conductive film 7 (and the fourth conductive film 9) and an etchant used for the third etching treatment is not particularly restricted in the present invention. For example, when the second conductive film 7 (and the fourth conductive film 9) is composed of molybdenum, an etchant usable for these films is an alkaline solution such as tetramethyl ammonium hydroxide (TMAH) or aqueous ammonia. Alternatively, an etchant such as a mixture of 2-(2-n-butoxyethoxy)ethanol and alkanolamine, or dimethyl sulfoxide (DMSO) may also be used.

When the second conductive film 7 is composed of tungsten, an etchant usable for the film is nitric acid, hydrofluoric acid, a solution of sodium hydroxide, or the like.

As described above, the first conductive film 6 (and the third conductive film 8) desirably has high etching resistance to such etchants.

As described above, the third etching treatment is desirably conducted by standard wet etching. Alternatively, the third etching treatment is also desirably conducted by an oxidation step of oxidizing the surface of the second conductive film 7 and a removal step of removing a part of or the entirety of the oxidized portion.

This is because, by forming an oxide film having a desired thickness in the surface of the second conductive film 7 in the oxidation step and subsequently removing the oxide film by etching, the effect of enhancing the uniformity (reproducibility) of the amount of the film to be etched can be expected.

The amount of a film to be oxidized (thickness of the resultant oxide film) is inversely proportional to the density of the film. For this reason, when the second conductive film 7 is subjected to an oxidation treatment, the surface layers of portions having low film density are mainly (selectively) oxidized. That is, by conducting the oxidation treatment and the etching treatment, the accuracy of controlling the sharpening of the tip portion (projected portion) of the second conductive film 7 can be further enhanced. In this case, when the second conductive film 7 and the gate 13 are in contact with each other in Step 5, the gap 11 can be formed with higher accuracy.

A technique used for the oxidation is not particularly restricted as long as use of the technique can result in oxidation of the surface of the second conductive film 7 in the depth of several nanometers to several tens of nanometers. Specifically, ozone oxidation (excimer UV exposure, low-pressure mercury exposure, a corona discharge treatment, or the like), thermal oxidation, or the like may be used. Desirably, excimer UV exposure, which is excellent in terms of quantitativeness of oxidation, is used. When the second conductive film 7 is composed of molybdenum, use of excimer UV exposure is advantageous in that an oxide film composed of $MoO_3$, which can be readily removed, is mainly generated.

The removal step of an oxide film may be conducted by a dry process or a wet process, desirably by a wet etching treatment. The removal step (etching step) of an oxide film is conducted for the purpose of removing (etching) only an oxide film serving as a surface layer. Accordingly, an etchant used for this step is desirably an etchant with which only an oxide film is removed but an underlying metal layer (unoxidized layer) is not substantially influenced, or an etchant with which an oxide film is etched at an etching rate much higher (by an order or orders of magnitude) than the etching rate of a metal layer (unoxidized layer). Specifically, when the second conductive film 7 is composed of molybdenum, an etchant for the film is diluted TMAH (desirably having a concentration of 0.238% or less), hot water (desirably having a temperature of 40° C. or more), or the like. When the second conductive film 7 is composed of tungsten, an etchant for the film is buffered hydrofluoric acid, diluted hydrochloric acid, hot water, or the like.

Regarding Step 7

The low work-function film 14 is desirably composed of a material having a work function lower than that of the cathode conductive film 10 and having a melting point higher than that of the cathode conductive film 10. The low work-function film 14 desirably has a work function of 4.0 eV or less, more desirably, 3.0 eV or less. The low work-function film 14 should cover at least the surface of the projected portion, which is the tip portion of the cathode conductive film 10. The low work-function film 14 may be formed also on the gate 13 (fourth conductive film 9).

Such a material having a low work function is, for example, n-type diamond, tetrahedral amorphous carbon (TA-C) doped with nitrogen, yttrium oxide ($Y_2O_3$), or the like.

Regarding Step 8

Step 8 is not necessarily conducted after Step 6 or Step 7. Step 8 may be conducted before Step 6 or Step 7.

The cathode electrode 2 has electrical conductivity and can be formed by a general vacuum film-formation method such as a deposition method or a sputtering method or a photolithographic technique. The cathode electrode 2 may be composed of a material that is the same as or different from the material of the gate electrode 5. Alternatively, the cathode conductive film 10 may also function as the cathode electrode 2.

The cathode electrode 2 has a thickness in the range of several tens of nanometers to several micrometers, desirably in the range of several tens of nanometers to several hundreds of nanometers.

Hereinafter, an image display apparatus including an electron source in which a plurality of the electron-emitting devices are arranged will be described with reference to FIGS. 9 to 11.

Figure 9:
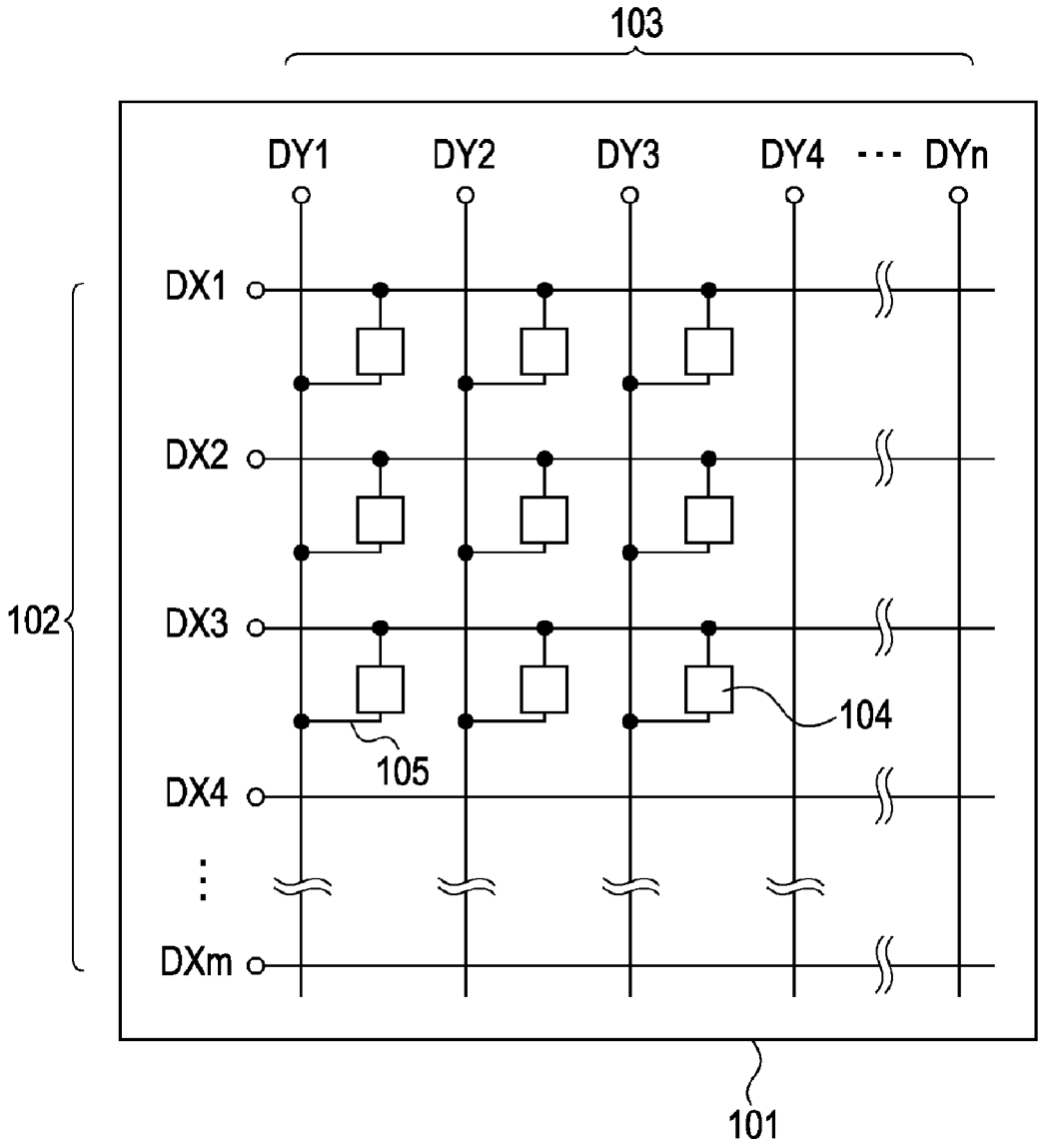
FIG. 9 is an explanatory view of an electron source in which electron-emitting devices are arranged.

Referring to FIG. 9, there are a substrate 101, X-direction wires 102, Y-direction wires 103, the above-described electron-emitting devices 104, and connections 105. The X-direction wires 102 are wires that each connect a row of the cathode electrodes 2. The Y-direction wires 103 are wires that each connect a column of the gate electrodes 5.

The X-direction wires 102 are constituted by m wires: DX1, DX2, . . . , DXm. The X-direction wires 102 can be formed of an electrically conducive material such as metal by a vacuum deposition method, a printing method, a sputtering method, or the like. The material, the film thickness, and the width of the X-direction wires 102 are appropriately designed.

The Y-direction wires 103 are constituted by n wires: DY1, DY2, . . . , DYn. The Y-direction wires 103 are formed in a manner similar to that in which the X-direction wires 102 are formed. An interlayer insulation layer (not shown) is provided between the m X-direction wires 102 and the n Y-direction wires 103 to thereby electrically separate the X-direction wires 102 and the Y-direction wires 103 from each other (m and n are positive integers).

The interlayer insulation layer (not shown) can be formed by a vacuum deposition method, a printing method, a sputtering method, or the like. For example, the interlayer insulation layer is formed in a desired shape in the entirety of or in a part of the surface of the substrate 101 on which the X-direction wires 102 are formed. In particular, the film thickness, the material, and the formation method of the interlayer insulation layer are appropriately designed so that the resultant interlayer insulation layer withstands the potential difference in the portions of the intersections of the X-direction wires 102 and the Y-direction wires 103. The X-direction wires 102 and the Y-direction wires 103 extend to form external terminals.

A material for forming the wires 102, a material for forming the wires 103, a material for forming the connections 105, a material for forming a cathode, and a material for forming a gate may share a part of or the entirety of the constituent elements, or may be different from each other.

The X-direction wires 102 are connected to a scanning signal application unit (not shown) configured to apply scanning signals for selecting a row of the electron-emitting devices 104 arranged in the X direction. The Y-direction wires 103 are connected to a modulating signal generation unit (not shown) configured to modulate each column of the electron-emitting devices 104 arranged in the Y direction in response to input signals.

A driving voltage applied to each electron-emitting device is fed as the voltage difference between the scanning signals and the modulating signals applied to each electron-emitting device.

In the above-described configuration, each device can be made independently operational by selecting each device with simple matrix wiring.

Figure 10:
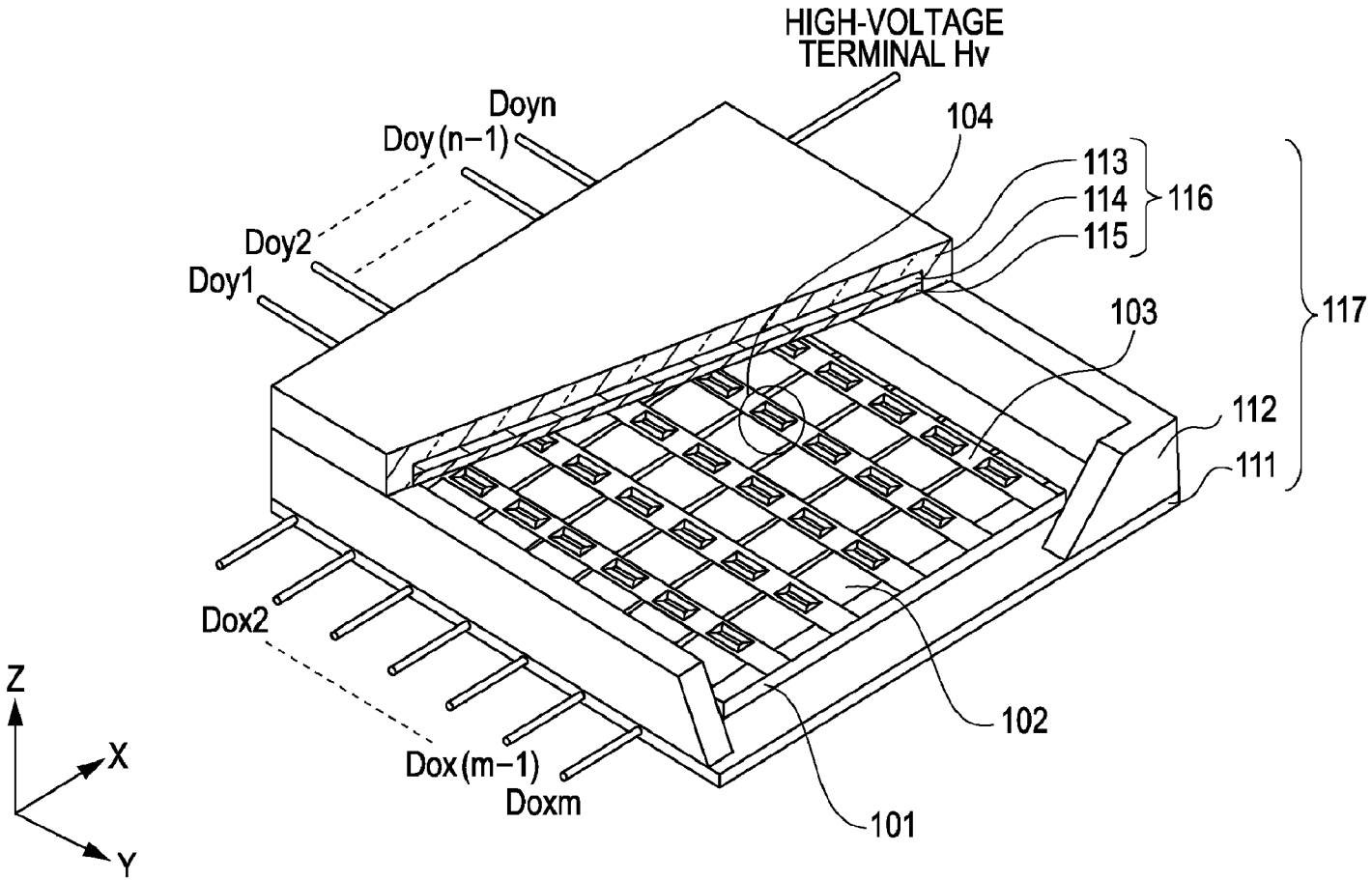
FIG. 10 is an explanatory view of an image display apparatus including electron-emitting devices.

Referring to FIG. 10, an image display apparatus including an electron source having such a simple matrix arrangement will be described. FIG. 10 is a schematic view of an example of an image display panel 117 of the image display apparatus.

In FIG. 10, there are a substrate 101 on which a plurality of electron-emitting devices are arranged; a rear plate 111 to which the substrate 101 is fixed; and a face plate 116 including a metal back 115 serving as an anode, a film (fluorescent material film) 114 serving as a light-emitting member, and the like that are formed on the inner surface of a glass substrate 113.

In FIG. 10, there is also a support frame 112. The rear plate 111 and the face plate 116 are sealingly bonded (joined) to the support frame 112 with a joining material such as frit glass. The rear plate 111, the support frame 112, and the face plate 116 compose an envelope. The envelope is formed by, for example, firing in the temperature range of 400° C. to 500° C. in the air or nitrogen for 10 or more minutes thereby being sealingly bonded.

An electron-emitting device 104 corresponds to the electron-emitting device illustrated in FIGS. 1A to 1C. X-direction wires 102 are connected to the cathode electrodes 2 of the electron-emitting devices 104. Y-direction wires 103 are connected to the gate electrodes 5 of the electron-emitting devices 104. The positional relationship among the electron-emitting devices 104 and the wires 102 and 103 is schematically illustrated in FIG. 10. Each electron-emitting device 104 is actually positioned on a substrate beside the portion of intersection of the wires 102 and 103.

As described above, the image display panel 117 includes the face plate 116, the support frame 112, and the rear plate 111. The rear plate 111 is provided mainly for the purpose of enhancing the strength of the substrate 101. For this reason, when the substrate 101 itself has sufficiently high strength, the rear plate 111 is not necessarily provided.

Specifically, the envelope may be formed by directly sealingly bonding the support frame 112 to the substrate 101 and sealingly bonding the support frame 112 to the face plate 116. Alternatively, the image display panel 117 having sufficiently high strength against the atmospheric pressure can be formed by providing a support member referred to as a spacer (not shown) between the face plate 116 and the rear plate 111.

Hereinafter, an example of the configuration of a driving circuit for displaying television images on the basis of television signals on the image display panel 117 will be described with reference to FIG. 11.

Figure 11:
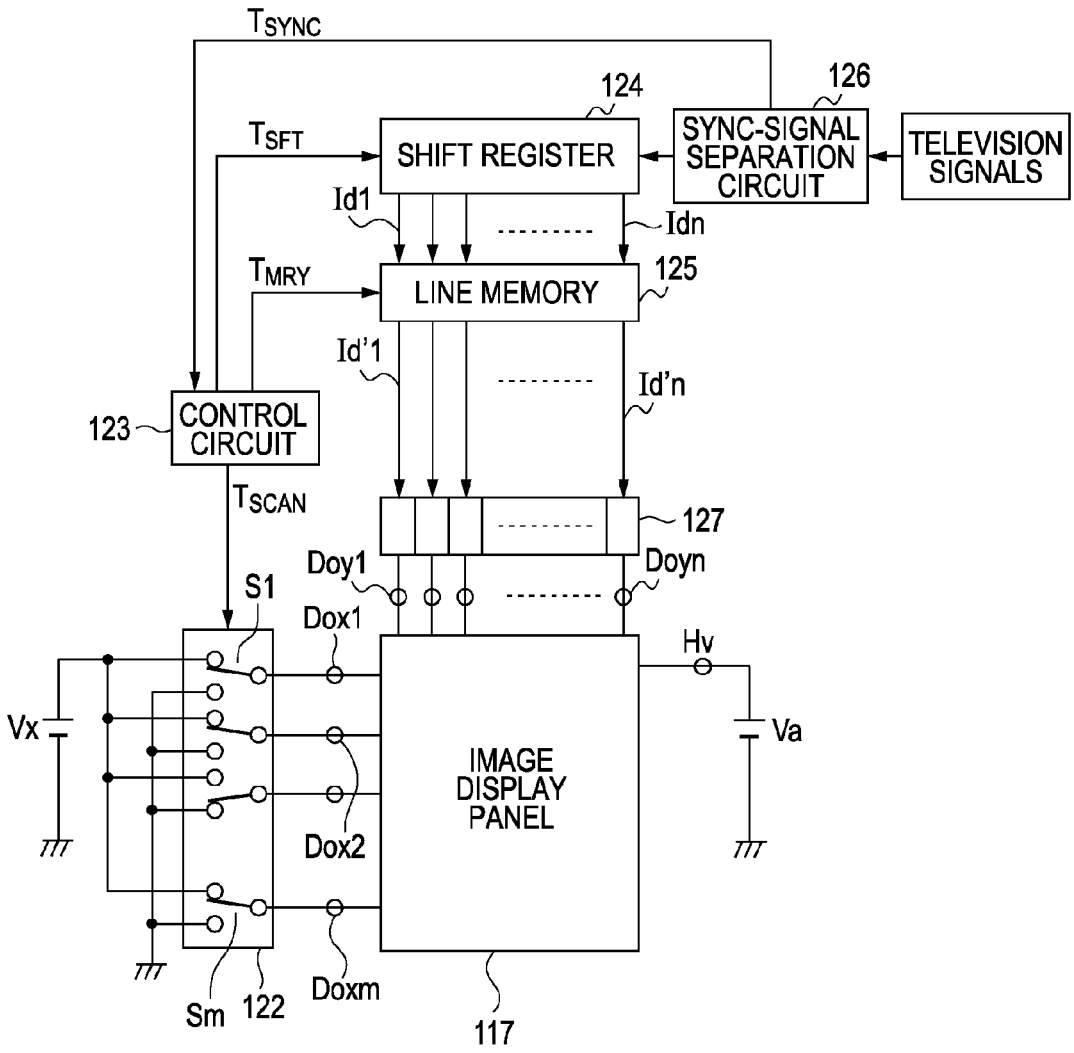
FIG. 11 is a circuit diagram of an example of a driving circuit for driving an image display apparatus.

In FIG. 11, there are the image display panel 117, a scanning circuit 122, a control circuit 123, a shift register 124, a line memory 125, a sync-signal separation circuit 126, a modulating signal generator 127, and direct voltage sources Vx and Va.

The image display panel 117 is connected to external electric circuits via terminals Dox1 to Doxm, terminals Doy1 to Doyn, and a high-voltage terminal Hv.

Scanning signals for sequentially driving an electron source provided in the image display panel 117, that is, a group of electron-emitting devices wired in a matrix with M rows and N columns on a row-by-row basis (each row including N devices), are applied to the terminals Dox1 to Doxm.

Modulating signals for controlling electron beams output from electron-emitting devices in a row selected by the scanning signals, are applied to the terminals Doy1 to Doyn.

A direct voltage of, for example, 10 [kV] is fed to the high-voltage terminal Hv from the direct voltage source Va.

As described above, image displaying can be achieved with scanning signals and modulating signals by applying a high voltage to the anode to thereby accelerate and radiate emitted electrons onto the fluorescent material.

EXAMPLES

Hereinafter, more specific examples based on the above-described embodiments will be described.

Example 1

An electron-emitting device including the first conductive film 6 composed of tantalum nitride (TaN) and the second conductive film 7 composed of molybdenum (Mo) was produced by a production method according to the present invention.

An example of a method for producing an electron-emitting device according to the present embodiment will be described with reference to FIGS. 4A to 5C.

Referring to FIG. 4A, the insulation layers 30 and 40 and the conductive layer 50 were stacked on the substrate 1. The substrate 1 was composed of high-strain-point low-sodium glass (PD200 manufactured by Asahi Glass Co., Ltd.).

As for the insulation layer 30, a $Si_3N_4$ film that was composed of a material having excellent processability and served as an insulation film was formed by a sputtering method. The insulation layer 30 had a thickness of 500 nm. As for the insulation layer 40, a $SiO_2$ film that was composed of a material having excellent processability and served as an insulation film was formed by a sputtering method. The insulation layer 40 had a thickness of 30 nm. As for the conductive layer 50, a TaN film was formed by a sputtering method. The conductive layer 50 had a thickness of 30 nm.

Referring to FIG. 4B, a resist pattern was then formed on the conductive layer 50 by a photolithographic technique and the conductive layer 50, the insulation layer 40, and the insulation layer 30 were sequentially processed by a dry etching technique. As a result of this first etching treatment, the conductive layer 50 was patterned into the gate electrode 5 and the insulation layer 30 was patterned into the first insulation layer 3.

A gas used for processing the insulation layers 30 and 40 and the conductive layer 50 in the first etching treatment was a $CF_4$-based gas. As a result of conducting RIE with this gas, the side surface 31 of the first insulation layer 3, the insulation layer 44, and the gate electrode 5 after the etching had an angle of about 80° with respect to the surface (horizontal surface) of the substrate 1. That is, the side surface 31 was an inclined surface.

After the resist was stripped off, referring to FIG. 4C, the insulation layer 44 was etched with BHF (high-purity buffered hydrofluoric acid LAL100 manufactured by STELLA CHEMIFA CORPORATION) such that the resultant recessed portion 42 had a depth of about 100 nm. As a result of this second etching treatment, the recessed portion 42 was formed.

Referring to FIG. 5A, a TaN film was then formed as the first conductive film 6 on the inclined surface 31 of the first insulation layer 3 and on the top surface 32 of the first insulation layer 3. Simultaneously, another TaN film was also formed on the gate electrode 5 to provide the third conductive film 8. In Example 1, the TaN films were formed by a sputtering method in which the substrate 1 was set to be horizontal with respect to a sputtering target.

The TaN film was formed on the inclined surface 31 of the first insulation layer 3 so as to have a thickness of 20 nm at a film-formation rate of 10 nm/min. At this time, the first conductive film 6 was formed so as not to be in contact with the gate electrode 5 or the third conductive film 8.

Referring to FIG. 5B, a molybdenum (Mo) film was formed as the second conductive film 7 on the first conductive film 6 so as to extend from the top surface 32 of the first insulation layer 3 through the corner portion 33 to the inclined surface 31. Simultaneously, another molybdenum film was also formed on the third conductive film 8 on the gate electrode 5 to provide the fourth conductive film 9. In Example 1, the Mo films were formed by a sputtering method in which the substrate 1 was set to be horizontal with respect to a molybdenum (Mo) target. In this film formation by sputtering in Example 1, a shielding plate was provided between the substrate 1 and the Mo target such that sputtering particles were directed to the substrate 1 at restricted angles (specifically, 90°±10° with respect to the substrate 1). Additionally, argon plasma was generated at a power of 3 kW and at a degree of vacuum of 0.1 Pa and the substrate 1 was placed such that the distance between the substrate 1 and the Mo target was 60 mm or less (mean free path at 0.1 Pa). The Mo film was then formed so as to have a thickness of 40 nm on the inclined surface 31 of the first insulation layer 3 at a film formation rate of 10 nm/min. At this time, the Mo film was formed such that the entry distance x of the second conductive film 7 into the recessed portion 42 was 35 nm. The second conductive film 7 was in contact with the fourth conductive film 9.

The second conductive film 7 (and the fourth conductive film 9) was observed with a transmission electron microscope (TEM) and analyzed by electron energy loss spectroscopy (EELS). The Mo film density of the second conductive film 7 (and the fourth conductive film 9) was calculated on the basis of the results of the observation and the analysis. The calculation revealed that the portion of the second conductive film 7 on the top surface 32 of the first insulation layer 3 (and on the top surface 52 of the gate electrode 5) had a film density of 10.0 g/cm$^3$; and the portion of the second conductive film 7 on the inclined surface 31 of the first insulation layer 3 (and on the side surface 51 of the gate electrode 5) had a film density of 7.8 g/cm$^3$.

Figure 8A:
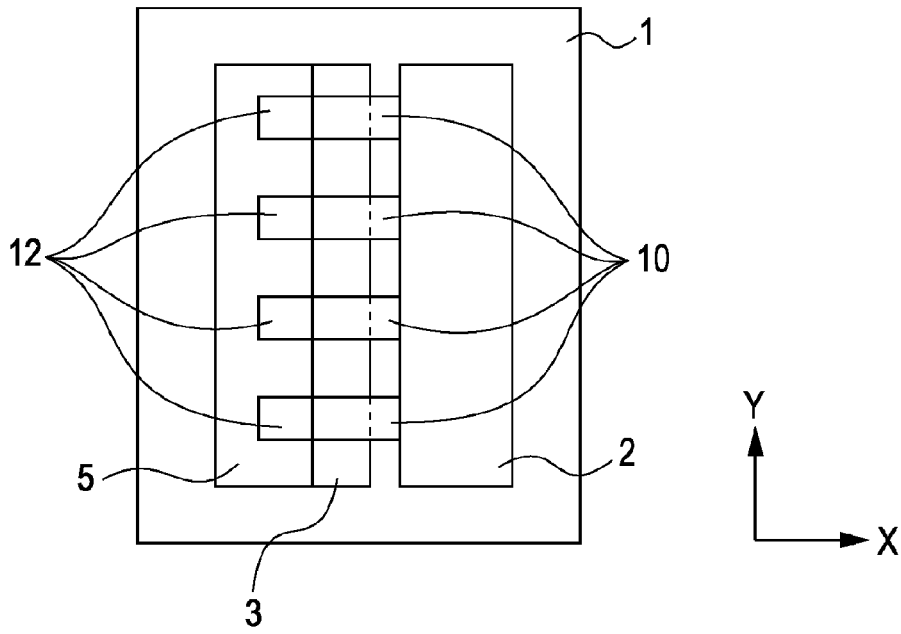
FIGS. 8A and 8B are explanatory views of a configuration in Example 1.
Figure 8B:
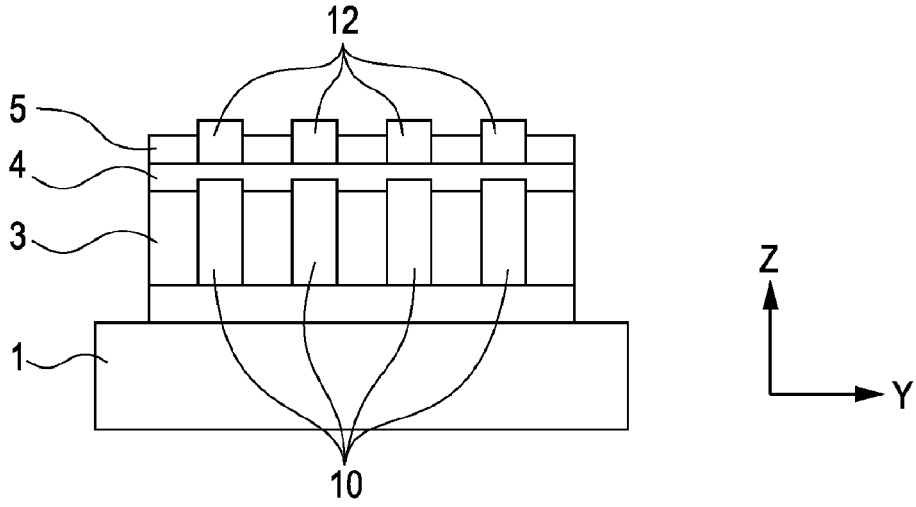

Referring to FIGS. 8A and 8B, the cathode conductive film 10 (the first conductive film 6 and the second conductive film 7) and the gate conductive film 12 (the third conductive film 8 and the fourth conductive film 9) were patterned into a plurality of sections arranged adjacent to one another in the Y direction. In the resultant configuration, even when a short circuit is caused between one section of the cathode conductive film 10 and one section of the gate 13 by discharging or the like and these sections were broken down, electron emission from the other sections of the conductive film can be maintained.

Specifically, a resist pattern was formed by a photolithographic technique so as to be a line and space pattern with which the cathode conductive film 10 and the gate conductive film 12 would be separated into sections having a width W of 3 μm. After that, the cathode conductive film 10 and the gate conductive film 12 were patterned by a dry etching technique through the resist pattern to form a plurality of strip-shaped sections of the cathode conductive film 10 and a plurality of strip-shaped sections of the gate conductive film 12. Since molybdenum is a material that provides a fluoride, a $CF_4$-based gas was used to process the films in this patterning. At the time when the resist was stripped off, the second conductive film 7 and the fourth conductive film 9 were in contact with each other.

Referring to FIG. 5C, to form a gap serving as an electron emission portion, the strip-shaped sections of the second conductive film 7 of the cathode conductive film 10 and the strip-shaped sections of the fourth conductive film 9 of the gate conductive film 12 were subjected to an etching treatment (third etching treatment).

The third etching treatment included a step of oxidizing the surfaces of the second conductive film 7 and the fourth conductive film 9 that are composed of Mo and a step of removing the oxidized surfaces.

Specifically, these Mo films were oxidized by radiation of excimer UV (wavelength: 172 nm; illuminance: 18 mW/cm$^2$) with an exposure apparatus at 350 mJ/cm$^2$ in the air. Under these conditions, oxide layers were formed in the surfaces of the second conductive film 7 and the fourth conductive film 9 in which the oxide layers in the low film-density portions had a film thickness of about 3 nm and the oxide layers in the high film-density portions had a film thickness of about 1 to 2 nm. After that, the second conductive film 7 and the fourth conductive film 9 were dipped into hot water (45° C.) for 5 minutes to thereby remove the molybdenum oxide layers. As a result of these steps, a gap was formed between the second conductive film 7 and the fourth conductive film 9.

Referring to FIG. 6A, the tip of the projected portion of the cathode conductive film 10 was subsequently sharpened. A technique used for this sharpening was the same as that in the third etching treatment. Specifically, the second conductive film 7 was etched by conducting an oxidation step with excimer UV (radiation at 350 mJ/cm$^2$) to thereby form a molybdenum oxide film and conducting a removal step with hot water (45° C., dipping for 5 minutes) to thereby remove the oxide film. This process was repeated three times.

Thus, in Example 1, the third etching treatment was conducted four times in total (four cycles, each cycle being constituted by the oxidation step and the removal step).

As a result of analysis with a cross-sectional transmission electron microscope, the gap dimension d between the second conductive film 7 and the gate 13 was 15 nm on average.

Referring to FIG. 8A, the cathode electrode 2 was subsequently formed. The cathode electrode 2 was formed of copper (Cu) by a sputtering method so as to have a thickness of 500 nm.

An electron-emitting device was thus produced by the above-described method. The electron-emitting device was then evaluated in terms of electron emission characteristics with the configuration illustrated in FIG. 3.

In this evaluation of electron emission characteristics, the potential of the gate electrode 5 was set at +34 V and the potential of the cathode electrode 2 was set at 0 V. Thus, a driving voltage Vf of 34 V was applied between the gate electrode 5 and the cathode electrode 2. As a result, the electron-emitting device had an average electron emission current Ie of 20 μA and an average electron emission efficiency of 15%. No leakage current due to contact between the cathode conductive film 10 and the gate 13 was detected.

An image display apparatus including a large number of such electron-emitting devices is excellent in terms of formability of electron beams and can maintain a good image for a long period of time without an image defect even when discharging occurs. Additionally, as a result of enhancement of the efficiency, an image display apparatus having low power consumption can be provided.

Example 2

In Example 2, an electron-emitting device including the first conductive film 6 composed of tantalum (Ta) and the second conductive film 7 composed of tungsten (W) was produced by a production method according to the present invention.

Since the steps up to and including the formation of the first insulation layer 3, the second insulation layer 4, and the gate electrode 5 are similar to the steps in Example 1, only differences from Example 1 will be described below.

Referring to FIG. 5A, Ta was deposited onto the inclined surface 31 of the first insulation layer 3 and the top surface 32 of the first insulation layer 3 to thereby form the first conductive film 6. Simultaneously, Ta was also deposited onto the gate electrode 5 to thereby form the third conductive film 8. In Example 2, the Ta films were formed by a sputtering method in which the substrate 1 was set to be horizontal with respect to a sputtering target. The Ta film was formed on the inclined surface 31 of the first insulation layer 3 so as to have a thickness of 20 nm at a film-formation rate of 10 nm/min. At this time, the first conductive film 6 was formed so as not to be in contact with the gate electrode 5 or the third conductive film 8.

Referring to FIG. 5B, a W film was formed as the second conductive film 7 on the first conductive film 6 so as to extend from the top surface 32 of the first insulation layer 3 to the side surface 31 of the first insulation layer 3.

Specifically, referring to FIG. 5B, the second conductive film 7 was formed by depositing W onto the first conductive film 6 so as to extend from the top surface 32 of the first insulation layer 3 through the corner portion 33 to the inclined surface 31. Simultaneously, W was also deposited onto the third conductive film 8 on the gate electrode 5 to provide the fourth conductive film 9. In Example 2, these W films were formed by a sputtering method in which the substrate 1 was set to be horizontal with respect to a target. In this film formation by sputtering in Example 2, a shielding plate was provided between the substrate 1 and the target such that sputtering particles were directed to the substrate 1 at restricted angles (specifically, 90°±10° with respect to the substrate 1). Additionally, argon plasma was generated at a power of 500 W and at a degree of vacuum of 0.1 Pa and the substrate 1 was placed such that the distance between the substrate 1 and the target was 60 mm or less (mean free path at 0.1 Pa). The W film was then formed so as to have a thickness of 40 nm on the inclined surface 31 of the first insulation layer 3 at a film formation rate of 10 nm/min. At this time, the W film was formed such that the entry distance x of the second conductive film 7 into the recessed portion 42 was 35 nm, and the angle at which the top surface 32 of the first insulation layer 3 and the second conductive film 7 were in contact with each other was 110°. At this time, the second conductive film 7 was in contact with the fourth conductive film 9.

As in Example 1, the cathode conductive film 10 and the gate conductive film 12 were processed into strip-shaped sections by dry etching. At this time, a $SF_6$-based gas was used to process the films. At this stage, the second conductive film 7 and the fourth conductive film 9 were still in contact with each other.

Referring to FIG. 5C, to form a gap, the strip-shaped sections of the cathode conductive film 10 and the gate conductive film 12 were subjected to a third etching treatment. The third etching treatment included a step of oxidizing tungsten surfaces and a step of removing the oxidized surfaces. Specifically, the W films were oxidized by radiation of excimer UV (wavelength: 172 nm; illuminance: 18 mW/cm$^2$) with an exposure apparatus at 150 mJ/cm$^2$ in the air. After that, the films were dipped into hot water (70° C.) for 5 minutes to thereby remove the tungsten oxide layers. As a result of these steps, a gap was formed between the cathode conductive film 10 and the gate 13.

Referring to FIG. 6A, the tip of the projected portion of the cathode conductive film 10 was subsequently sharpened. A technique used for this sharpening was the same as that in the third etching treatment. Specifically, the second conductive film 7 was etched by conducting an oxidation step to thereby form a tungsten oxide film and conducting a removal step to thereby remove the oxide film.

In Example 2, one cycle constituted by the oxidation step with excimer UV (radiation at 150 mJ/cm$^2$) and the oxide-film removal step with hot water (70° C., dipping for 5 minutes) was repeated twice.

As a result of analysis with a cross-sectional transmission electron microscope, the gap dimension d between the cathode conductive film 10 and the gate 13 was 13 nm on average.

The Ta film formed as the first conductive film 6 was exposed on the inclined surface 31 of the first insulation layer 3. This Ta film had a thickness of 20 nm and was scarcely etched.

Referring to FIG. 8A, the cathode electrode 2 was subsequently formed. The cathode electrode 2 was formed of copper (Cu) by a sputtering method so as to have a thickness of 500 nm.

An electron-emitting device was thus produced by the above-described method. The electron-emitting device was then evaluated in terms of electron emission characteristics with the configuration illustrated in FIG. 3.

In this evaluation of electron emission characteristics, the potential of the gate electrode 5 was set at +30 V and the potential of the cathode electrode 2 was set at 0 V. Thus, a driving voltage Vf of 30 V was applied between the gate electrode 5 and the cathode electrode 2. As a result, the electron-emitting device had an average electron emission current Ie of 12 μA and an average electron emission efficiency of 11%. No leakage current due to contact between the cathode conductive film 10 and the gate 13 (conductive films 60B1 to 60B4) was detected.

An image display apparatus including this electron-emitting device can be provided that is excellent in terms of formability of electron beams. Additionally, an image display apparatus displaying good images can be achieved and, as a result of enhancement of the efficiency, an image display apparatus having low power consumption can be provided.

Example 3

In Example 3, an electron-emitting device including the first conductive film 6 composed of high film-quality molybdenum (Mo) and the second conductive film 7 composed of low film-quality molybdenum (Mo) was produced by a production method according to the present invention.

Since the steps up to and including the formation of the first insulation layer 3, the second insulation layer 4, and the gate electrode 5 are similar to the steps in Example 1, only differences from Example 1 will be described below.

Referring to FIG. 5A, Mo was deposited onto the inclined surface 31 of the first insulation layer 3 and the top surface 32 of the first insulation layer 3 to thereby form the first conductive film 6. Simultaneously, Mo was also deposited onto the gate electrode 5 to thereby form the third conductive film 8. In Example 3, these Mo films were formed by a sputtering method. In this sputtering method, a shielding plate was provided between the substrate 1 and a sputtering target such that sputtering particles were directed to the substrate 1 at restricted angles (specifically, 90°±10° with respect to the inclined surface 31 of the first insulation layer 3). The Mo film on the inclined surface 31 was formed so as to have a thickness of 20 nm at a deposition rate of 10 nm/min. Thus, the Mo film having high film density was formed on the inclined surface 31.

At this time, the first conductive film 6 was formed so as not to be in contact with the gate electrode 5 or the third conductive film 8.

Referring to FIG. 5B, Mo was then deposited onto the high-density Mo on the top surface 32 and the inclined surface 31 of the first insulation layer 3 by a sputtering method to thereby form the second conductive film 7. Simultaneously, Mo was also deposited onto Mo on the gate electrode 5. In this sputtering method in Example 3, a shielding plate was provided between the substrate 1 and a target such that sputtering particles were directed to the substrate 1 at restricted angles (specifically, 90°±10° with respect to the surface of the substrate 1). The Mo film was formed on the top surface 32 of the first insulation layer 3 so as to have a thickness of 40 nm at a deposition rate of 10 nm/min. As a result, a Mo film having high film density was formed on the inclined surface 31 of the first insulation layer 3.

The Mo films were observed with a transmission electron microscope (TEM) and analyzed by electron energy loss spectroscopy (EELS) and the film density of the Mo films was calculated. The Mo film on the inclined surface 31 had a film density of 10.0 g/cm$^3$. The Mo film on the top surface 32 had a film density of 7.8 g/cm$^3$.

As in Example 1, the cathode conductive film 10 and the gate conductive film 12 were subsequently processed into strip-shaped sections by dry etching. At this time, a $SF_6$-based gas was used to process the films.

At this stage, the second conductive film 7 and the fourth conductive film 9 were still in contact with each other.

Referring to FIG. 5C, to form a gap, the strip-shaped sections of the cathode conductive film 10 and the gate conductive film 12 were subjected to a third etching treatment. The third etching treatment was conducted by dipping and shaking the films in 0.238% TMAH solution being heated to 40° C. for 30 minutes.

As a result of analysis with a cross-sectional transmission electron microscope, the gap dimension d between the projected portion of the cathode conductive film 10 and the gate 13 was 12 nm on average.

The high film-density Mo film formed as the first conductive film 6 was exposed on the inclined surface 31 of the first insulation layer 3. This Mo film had a thickness of 20 nm and was scarcely etched.

Referring to FIG. 8A, the cathode electrode 2 was subsequently formed. The cathode electrode 2 was formed of copper (Cu) by a sputtering method so as to have a thickness of 500 nm.

An electron-emitting device was thus produced by the above-described method. The electron-emitting device was then evaluated in terms of electron emission characteristics with the configuration illustrated in FIG. 3.

In this evaluation of electron emission characteristics, the potential of the gate electrode 5 was set at +30 V and the potential of the cathode electrode 2 was set at 0 V. Thus, a driving voltage Vf of 30 V was applied between the gate electrode 5 and the cathode electrode 2. As a result, the electron-emitting device had an average electron emission current Ie of 12 μA and an average electron emission efficiency of 11%. No leakage current due to contact between the cathode conductive film 10 and the gate 13 (conductive films 60B1 to 60B4) was detected.

An image display apparatus including this electron-emitting device can be provided that is excellent in terms of formability of electron beams. Additionally, an image display apparatus displaying good images can be achieved and, as a result of enhancement of the efficiency, an image display apparatus having low power consumption can be provided.

Example 4

An electron-emitting device in which the efficiency was enhanced by sharpening the cathode conductive film 10 serving as an electron emission portion was produced by a production method according to the present invention. Characteristics of the electron source of the electron-emitting device was evaluated.

Since the production method used was basically similar to that in Example 1, only differences from Example 1 will be described below.

The production method similar to that in Example 1 up to and including the third etching treatments was conducted. Note that, in Example 4, a cycle constituted by the oxidation step and the removal step was repeated 7 times instead of 4 times. As a result, while the cathode conductive film 10 was further sharpened, the gap between the gate 13 and the cathode conductive film 10 was widened to 23 nm. Although the TaN film was exposed on the inclined surface 31 of the first insulation layer 3, the TaN film was scarcely etched.

Referring to FIG. 6B, a low work-function material was deposited onto the second conductive film 7 on the top surface 32 through a metal mask to thereby form the low work-function film 14. The low work-function film 14 was also formed on the gate conductive film 12 and the second conductive film 7 on the inclined surface 31.

In Example 4, yttrium oxide ($Y_2O_3$) was used as the low work-function material. The $Y_2O_3$ film was formed by forming an amorphous $Y_2O_3$ film so as to have a thickness of 10 nm by an ion plating method, and heating the substrate 1 in an argon atmosphere containing 21% oxygen at 400° C.

As a result of analysis with a cross-sectional transmission electron microscope, the gap between the projected portion of the cathode serving as an electron emission portion and the projected portion of the gate electrode in FIG. 6B had a gap dimension d of 5 nm on average.

As in Example 1, the cathode electrode 2 was subsequently formed of Cu. The electron source was evaluated with the configuration illustrated in FIG. 3.

In this evaluation of electron emission characteristics, the potential of the gate electrode 5 was set at +26 V and the potential of the cathode electrode 2 was set at 0 V. Thus, a driving voltage Vf of 26 V was applied between the gate electrode 5 and the cathode electrode 2. As a result, the electron-emitting device had an average electron emission current Ie of 25 μA and an average electron emission efficiency of 17%. No leakage current due to contact between the cathode conductive film 10 and the gate 13 was detected.

An image display apparatus including this electron-emitting device can be provided that is excellent in terms of formability of electron beams. Additionally, an image display apparatus displaying good images can be achieved and, as a result of enhancement of the efficiency, an image display apparatus having low power consumption can be provided.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-324466 filed Dec. 19, 2008, which is hereby incorporated by reference herein in its entirety.

What is claimed is:

1. A method for producing an electron-emitting device comprising:

providing a substrate;

forming a first conductive film on a side surface of an insulation layer including the side surface and a top surface connected to the side surface;

forming a second conductive film from the top surface to the side surface and on the first conductive film; and connected to the side surface on the substrate;

etching the second conductive film, wherein the second conductive film is formed such that a portion of the second conductive film on the top surface has a higher film density than a portion of the second conductive film on the side surface to provide the portion of the second conductive film having a high film density and the portion of the second conductive film having a low film density, and the portion of the second conductive film having the low film density is etched more than the portion of the second conductive film having the high film density.

2. The method according to claim 1, wherein the second conductive film is etched with an etchant.

3. The method according to claim 2, wherein a portion of the first conductive film on the side surface is etched with the etchant at a lower etching rate than the portion of the second conductive film on the side surface.

4. The method according to claim 1, wherein, the portion of the first conductive film on the side surface has a higher film density than the portion of the second conductive film on the side surface.

5. The method according to claim 1, wherein the first conductive film is composed of a material different from a material of the second conductive film.

6. The method according to claim 1, wherein a conditional expression below is satisfied:

$$T_{1s}/E_{1s}+T_{2s}/E_{2s} \geqq T_{2t}/E_{2t}$$ where $T_{1s}$ represents a film thickness of the portion of the first conductive film on the side surface; $E_{1s}$ represents an etching rate of the portion of the first conductive film on the side surface with respect to the etching; $T_{2s}$ represents a film thickness of the portion of the second conductive film on the side surface; $E_{2s}$ represents an etching rate of the portion of the second conductive film on the side surface with respect to the etching; $T_{2t}$ represents a film thickness of the portion of the second conductive film on the top surface; and $E_{2t}$ represents an etching rate of the portion of the second conductive film on the top surface with respect to the etching.

7. The method according to claim 1, wherein the first conductive film is formed also on the top surface such that the portion of the first conductive film on the side surface has a higher film density than the portion of the first conductive film on the top surface.

8. The method according to claim 1, wherein the etching includes oxidizing a surface of the second conductive film to provide an oxidized portion and removing a part of the oxidized portion.

9. The method according to claim 8, wherein the oxidizing and the removing are repeated.

10. The method according to claim 1, further comprising:

forming an electrode above the top surface, wherein the electrode is in connection with the second conductive film, and in the etching, a gap is formed between the electrode and the second conductive film.

11. The method according to claim 10, wherein simultaneously when the second conductive film is formed, a conductive film other than the first conductive film is formed on the electrode so as to be in contact with the second conductive film, and the conductive film formed on the electrode is separated from the second conductive film in the etching.

12. A method for producing image display apparatus including a plurality of electron-emitting devices, and a light-emitting member to which electrons emitted from the plurality of electron-emitting devices are radiated, the method comprising;

producing a plurality of electron-emitting devices comprising:

providing a substrate;

forming a first conductive film on a side surface of an insulation layer including the side surface and a top surface connected to the side surface on the substrate;

forming a second conductive film from the top surface to the side surface and on the first conductive film; and etching the second conductive film, wherein the second conductive film is formed such that a portion of the second conductive film on the top surface has a higher film density than a portion of the second conductive film having on the side surface to provide the portion of the second conductive film having a high film density and the portion of the second conductive film having a low film density, and the portion of the second conductive film having the low film density is etched more than the portion of the second conductive film having the high density; and providing a face plate which a light-emitting member facing to the plurality of electron-emitting devices.

13. The method according to claim 12, wherein the second conductive film is etched with an etchant.

14. The method according to claim 13, wherein a portion of the first conductive film on the side surface is etched with the etchant at a lower etching rate than the portion of the second conductive film on the side surface.

15. The method according to claim 12, wherein, the portion of the first conductive film on the side surface has a higher film density than the portion of the second conductive film on the side surface.

16. The method according to claim 12, wherein the first conductive film is composed of a material different from a material of the second conductive film.

17. The method according to claim 12, wherein a conditional expression below is satisfied:

$$T_{1s}/E_{1s}+T_{2s}/E_{2s} \geqq T_{2t}/E_{2t}$$

where $T_{1s}$ represents a film thickness of the portion of the first conductive film on the side surface; $E_{1s}$ represents an etching rate of the portion of the first conductive film on the side surface with respect to the etching; $T_{2s}$ represents a film thickness of the portion of the second conductive film on the side surface; $E_{2s}$ represents an etching rate of the portion of the second conductive film on the side surface with respect to the etching; $T_{2t}$ represents a film thickness of the portion of the second conductive film on the top surface; and $E_{2t}$ represents an etching rate of the portion of the second conductive film on the top surface with respect to the etching.

18. The method according to claim 12, wherein the first conductive film is formed also on the top surface such that the portion of the first conductive film on the side surface has a higher film density than the portion of the first conductive film on the top surface.

19. The method according to claim 12, wherein the etching includes oxidizing a surface of the second conductive film to provide an oxidized portion and removing a part of the oxidized portion.

20. The method according to claim 12, further comprising:

forming an electrode above the top surface, wherein the electrode is in connection with the second conductive film, and in the etching, a gap is formed between the electrode and the second conductive film.

* * * * *